US010179475B2

(12) United States Patent
Roth

(10) Patent No.: US 10,179,475 B2
(45) Date of Patent: Jan. 15, 2019

(54) REPEAT PATTERN SURFACE MARKING SYSTEM AND KIT

(71) Applicant: Edward Roth, Brooklyn, NY (US)

(72) Inventor: Edward Roth, Brooklyn, NY (US)

( * ) Notice: Subject to any disclaimer, the term of this patent is extended or adjusted under 35 U.S.C. 154(b) by 112 days.

(21) Appl. No.: 15/373,249

(22) Filed: Dec. 8, 2016

(65) Prior Publication Data

US 2017/0157915 A1 Jun. 8, 2017

Related U.S. Application Data

(60) Provisional application No. 62/264,378, filed on Dec. 8, 2015.

(51) Int. Cl.
*B44D 3/00* (2006.01)
*B44D 2/00* (2006.01)

(52) U.S. Cl.
CPC ..... *B44D 2/007* (2013.01); *B44D 2/002* (2013.01)

(58) Field of Classification Search
CPC . B41N 1/24; B41N 1/241; B44D 2/00; B44D 2/002; B44D 2/007; B44C 1/1733; B43L 13/208; G02B 3/10; G02B 2003/1097
See application file for complete search history.

(56) References Cited

U.S. PATENT DOCUMENTS 2,421,825 A * 6/1947 Aulick ..... B05C 17/06 101/127
3,025,788 A * 3/1962 Tregoning ..... B05C 17/06 101/127.1
3,633,286 A 1/1972 Maurer et al.
3,665,889 A 5/1972 Wagenvoord
3,925,586 A 12/1975 Maxwell
4,125,658 A * 11/1978 Miles ..... B43L 13/208 101/127
4,129,669 A 12/1978 Lopez
4,135,020 A 1/1979 Maxwell
4,339,886 A * 7/1982 Griffiths ..... G09F 7/16 40/595
4,597,829 A 7/1986 Sato et al.
(Continued)

*Primary Examiner* — Leslie J Evanisko
*Assistant Examiner* — Marissa Ferguson-Samreth
(74) *Attorney, Agent, or Firm* — Christopher J. Scott

(57) ABSTRACT

A surface marking system, kit, and method enables a user to mark a pattern upon a surface. The components may include a rectangular marking material transfer body, a particularly marked alignment tape, and a series of spacer elements. The marking material transfer body includes a fixed dimension and at least one marking material transfer portion. The outer perimeter includes opposed mark-alignment edges. The alignment tape has a fixed width, a select length, and a marked anterior surface. The marked anterior surface includes a series of width-wise marks and a length-wise mark. The length-wise mark is centered relative to the fixed tape width. A select body dimension is firstly and successively positioned at a select number of sequentially spaced width-wise marks and mark-alignment edges are firstly and successively alignable with parallel length-wise marks. The spacer elements ensure parallel arrangement of the length-wise marks and provide overlap sections adjacent the mark-alignment edges.

12 Claims, 18 Drawing Sheets

(56) References Cited

U.S. PATENT DOCUMENTS 4,852,483 A * 8/1989 Bussard ..... B41F 15/02 101/128
4,907,505 A 3/1990 Ericsson et al.
5,012,590 A * 5/1991 Wagner ..... B25H 7/00 33/494
5,100,324 A 3/1992 Slayton
5,141,438 A 8/1992 Spector
5,460,087 A 10/1995 Ogorzalek
5,866,206 A * 2/1999 Jennings-Tolchiner ..... B44D 2/00 427/256
5,967,031 A * 10/1999 Gauss ..... B41C 1/14 101/115
6,045,639 A * 4/2000 Davis ..... B44C 1/1733 156/234
6,055,738 A 5/2000 Bardeen et al.
6,142,071 A * 11/2000 Fexer ..... B05C 17/06 101/114
6,284,075 B1 * 9/2001 Kaplan ..... B05C 17/02 156/574
6,652,907 B1 11/2003 Stever
6,829,990 B2 12/2004 Cochran et al.
7,334,518 B2 2/2008 Cox et al.
8,061,269 B2 11/2011 Bass et al.
8,413,579 B2 4/2013 Ferreti
8,499,689 B2 8/2013 Bass et al.
8,557,758 B2 10/2013 Shah et al.
8,661,702 B2 3/2014 Ihm
2003/0141012 A1 * 7/2003 Ketterer ..... B44D 2/002 156/230
2003/0205152 A1 11/2003 Houtzer
2005/0229421 A1 10/2005 Deas et al.
2005/0257393 A1 * 11/2005 Spanski ..... G01B 3/1002 33/758
2006/0096112 A1 * 5/2006 Berring ..... G01B 3/10 33/759
2006/0099412 A1 5/2006 Ross
2006/0107850 A1 5/2006 Rinaldi et al.
2006/0123650 A1 6/2006 Mullins
2007/0014921 A1 1/2007 Kimball et al.
2007/0095220 A1 * 5/2007 Cox ..... B44D 2/002 101/127
2007/0164553 A1 7/2007 Katz et al.
2008/0047444 A1 * 2/2008 Fields ..... B44D 2/002 101/127
2009/0074994 A1 3/2009 McLean
2009/0282992 A1 11/2009 Mulrooney
2011/0056510 A1 3/2011 Westlake
2015/0090135 A1 * 4/2015 Miller ..... B41N 1/241 101/128.1
2016/0068013 A1 * 3/2016 Munoz ..... B44D 2/007 101/127

* cited by examiner

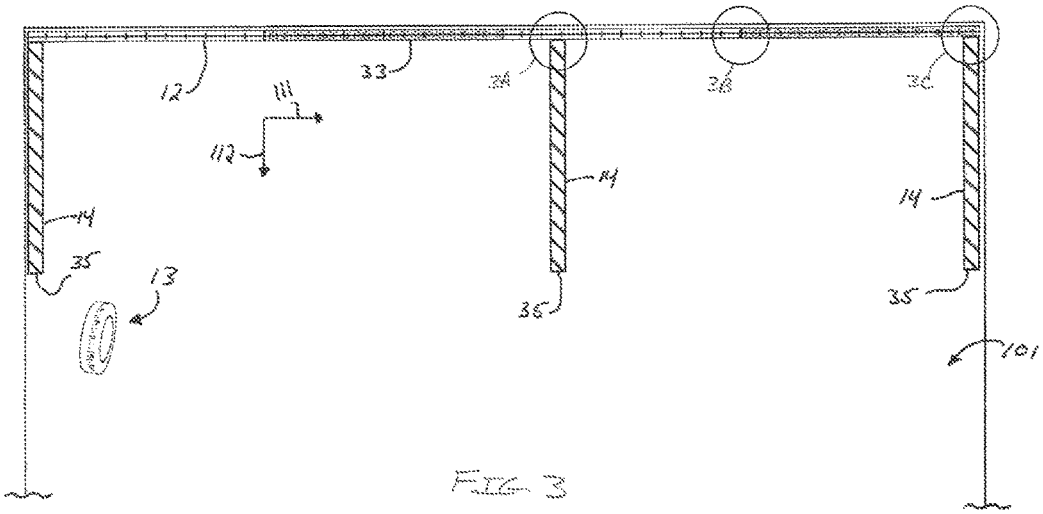
FIG. 3
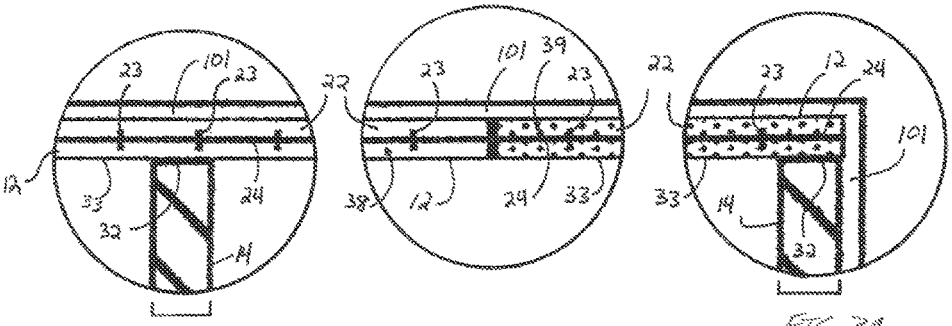
FIG. 3A
FIG. 3B
FIG. 3C

REPEAT PATTERN SURFACE MARKING SYSTEM AND KIT

PRIOR HISTORY

This patent application claims the benefit of U.S. Provisional Patent Application No. 62/264,378 filed in the United States Patent and Trademark Office on 8 Dec. 2015.

BACKGROUND OF THE INVENTION

Field of the Invention

The disclosed invention generally relates to a system to create a repeat pattern on an underlying surface or medium primarily using stencils. More particularly, the disclosed invention provides a series of components in system or kit form for enabling users thereof to quickly and effectively form a grid-like layout upon an underlying surface or medium for enabling a user to create a repeat pattern upon the underlying surface via a re-positionable marking material transfer body and the grid-like layout.

Brief Description of the Prior Art

A stencil or stencil template may be defined structurally as a first type of marking material transfer body. Traditionally, stencils provide cutouts or registration features by which the user can mark the underlying surface so as to properly align the stencil upon the surface as exemplified by a paintable wall. The cutouts or registration features may thus be used to repeat placement of the stencil upon the surface for repeating the stencil pattern. There is great difficulty, however, in having to hand draw and properly align registration marks (e.g. small triangles) on the wall or surface prior to applying the paint or marking material.

In other words, state of the art stencils incorporating registration features are highly problematic. Most state of the art "repeat" stencils have 4 triangles cut into the design in the four corners to be traced on the wall, shifted over, aligned, and repeated upon the underlying surface until a full grid is effectively marked upon the underlying surface to aid the artist in creating the repeat pattern. An alternative method to prevent marks directly upon the actual underlying surface (requiring labor intensive removal or masking) involves the placement of a removable layer (e.g. a piece of tape) at the registration mark feature so that when registration marks are made, the removable layer with registration mark can be quickly removed. In either event, it will thus be understood that the process of registration marking is cumbersome and time-consuming.

A number of prior art teachings show or teach registration cutouts or features as briefly described while a number of other prior art teachings show or teach stencil kits and systems developed to date. Some of the more pertinent prior art teachings are briefly described hereinafter. U.S. Pat. No. 3,633,286 ('286 patent), issued to Maurer, for example discloses a Stencil-Drawing Toy. The '286 patent describes a stencil having a plurality of composite stencil openings, each defining different features of predetermined composite designs. The stencil also includes means for guiding the overlaying of the openings in predetermined relationships to produce a desired design.

The overlaying guidance may take the form of outlines on the stencil of completed designs not provided by the outlines of the openings. Also, irregularities such as tabs and notches in the outer edges of the stencil may be used for overlaying registration. Further, a frame having a stencil accepting aperture dimensioned to removably hold the stencil in a desired position while allowing rectilinear repositioning may be utilized. The frame and stencil may also include means including coded indexing positions for properly locating the stencil in the frame and for indicating which of the stencil openings are to be used.

U.S. Pat. No. 3,665,889 ('889 patent), issued to Wagenvoord, discloses Stencils for Producing a Composite Display. The '889 patent describes series of stencils for use in sequence to produce a composite display. Each stencil has openings defining a portion of the total display, and pressure sensitive adhesive on one face for temporarily mounting it on the display surface. Registration guide means may be carried by but separable from the first stencil of the sequence, or may be independent elements positioned on the display surface in accordance with the position of the first stencil. Each subsequent stencil carries registration indicator means cooperable with the guide means. The stencils may be transparent and bear indicia indicating the order in which they are to be used and the nature of the display material to be used with them.

U.S. Pat. No. 4,597,829 ('829 patent), issued to Sato et al., discloses a Stencil, Stencil Material Kit and Stencil Duplicator Kit. The '829 patent describes a stencil from which a pattern-wise perforated stencil can be easily made by handwriting, a stencil material kit with which a pattern-wise perforated stencil can be made, and a stencil duplicator kit which, in combination with the stencil, performs simple, clear printing. The stencil is made up of a porous support and a masking film formed thereon, said masking film being made of a water-insoluble polymer having tertiary amino groups. The stencil material kit contains the stencil and a pattern-wise perforated stencil-making solution which forms a water-soluble product upon reaction with said polymer. Stencil printing is performed using the pattern-wise perforated stencil, a stencil duplicator and printing ink.

U.S. Pat. No. 5,141,438 ('438 patent), issued to Spector, discloses an Art Craft Kit. The '438 patent describes a kit for enabling a user to reproduce a painting, a map, or other multi-colored artwork printed on a master sheet having a pressure-sensitive adhesive backing, the master sheet being adhered to the face of a blank canvas or other copy sheet. The printed artwork is dissected into stencil segments, the periphery of each segment being defined by a contoured line of perforations. To reproduce the artwork, the user runs a pointed tool along the contoured line defining a selected segment, thereby cutting this line and separating the segment which is then removed from the master sheet to expose a corresponding blank segment on the copy sheet. Using the removed stencil segment as a guide, the user colors in the blank segment of the copy sheet to match as best he can, the portion of the artwork appearing on the removed segment. This operation is subsequently repeated until all stencil segments on the master sheet are removed and the artwork is reproduced on the copy sheet.

U.S. Pat. No. 5,460,087 ('087 patent), issued to Ogorzalek, discloses a Stencil Set for Decorative Window Trim. The '087 patent describes a stencil kit for applying decorative patterns and designs to architectural structures in which the kit includes one or more stencil templates fabricated from a closed-cell foam sheet with pattern and design cut-outs through which paint is applied to the surface of the architectural structure, the foam sheet having a contact side with a temporary stick adhesive for adhering the template to the surface of the architectural structure, and a top side with a surface allowing removal of misapplied paint, the stencil kit also including paint and stipple brushes for application of the patterns and designs.

U.S. Pat. No. 6,829,990 ('990 patent), issued to Cochran et al., discloses a Stencil Assembly. The '990 patent describes certain means for applying a stenciled design or message on a surface including a reusable stencil base operable to frame an elongated opening straddled by two opposite, spaced-apart interior long edges. The stencil base further includes at least one exterior long edge parallel to the interior long edge, and a number of female stencil base cut-outs along the long edges. A number of stencil pieces of sufficient size for close insertion in the opening are formed of a common material and generally have a common length. The stencil pieces are interchangeably arrangeable in the opening between the interior long edges by way of matable male stencil piece projections and female stencil base cut-outs.

From a review of the foregoing citations in particular, and from a consideration of the prior art in general, it will be seen that the prior art perceives a need for a repeat pattern stenciling system or kit that provides certain adjustable stencil alignment and placement means that do not require the user to mark the underlying surface. In other words, the prior art perceives a need for a stencil system of components operable to provide a user with an ability to form an adjustable grid-like layout for ease of stencil re-placement over the surface area of the entire grid-like layout for further enabling the user to quickly and effectively apply a marking material to the underlying surface for forming a repeating pattern upon the underlying surface.

SUMMARY OF THE INVENTION

Given the shortcomings of the prior art and the perceived need for improved stenciling methodology, the author initially contemplated a roll of tape with the registration marks on it would alleviate certain steps. The concept of registration-marked tape gave way, however, to a more simply marked anterior tape surface with periodic and uniformly spaced width-wise marks for aiding the user in stencil template placement. A further consideration was the need to increase the ease by which successive rows could be aligned and leveled. Provided a first row could be made level, a series of uniformly dimensioned spacer elements would operate to maintain consistent spacing between successive rows of alignment tapes.

Accordingly, if the user levels only the first row of tape, and then uses the spacer elements according to the present invention, successive rows of tape very well align easily relative to the first row. Accordingly, the user places the first row of alignment tape and level checks it. Spacer elements are then attached or positioned below the first row of tape preferably at the beginning middle and end of the first row of alignment tape.

A successive length of alignment tape is then placed below by way of the spacer elements as a guide, and the process is then repeated. The stencils may thus align between the successive rows of tape, and using the width-wise marks or guides on the tape, the user may align the stencil between matching mark points and overlap the stencil at these marks as indicated. Marking material such as paint may then be applied to the stencil, which stencil may thereafter be re-positioned to any part of the layout for successive stencil patterning.

The stenciling system, kit, and method according to the present invention addresses the shortcomings in the prior art and provides certain means for quickly, and without the requirement of registration marks, placing a grid-like layout upon an underlying surface for enabling the user to form a wallpaper effect of repeat, stencil-based patterns. In this new system, tape in the system is pre-marked and the user begins by making horizontal (or vertical) tape stripes on an underlying surface using a level, spacing the tape stripes at equal vertical (or horizontal) distances using the spacer elements.

As indicated, the spacer elements ensure equal spacing between successive rows (or columns) of alignment tape. The alignment tape according to the present invention provides alignment marks so all rows of tape can be started at a uniform reference point, aligned, and made to visually appear identical. Once all rows of tape are on the wall, the user may align the stencil corners with the marked off areas on the tape, overlapping the tape with the stencil. When the stencil is in place, aligned between two rows of tape and overlapping in the designated areas, the user simply paints in over the stencil. The stencil is then repositioned at any other part of the taped layout and the process is repeated.

The pre-marked tape and spacer elements remove the cumbersome requirement of having to measure, repetitively level, and consider mathematical operations enabling the user to be more creative with the project. A primary highlight of the stencil system, kit, and method according to the present invention is its flexibility. A user can be provided with 6-inch square stencils or 12-inch square stencils, for example. Further, the user can fill in every other column for a vertically striped effect. Further, the user can paint every other square area with a different stencil color. Still further, the user can vary two different stencil designs as it is a modular grid system. Other features and objectives of the invention will become more evident from a consideration of the following brief descriptions of patent drawings:

BRIEF DESCRIPTION OF THE DRAWINGS

FIG. 3 is a second sequential diagrammatic depiction of a second stenciling method step according to the present invention depicting a series of spacer elements being aligned against a first tape edge of the first length of alignment tape and extended in a second direction or dimension orthogonal to the first direction or dimension upon a fragmentary underlying surface.

FIG. 3A is an enlarged fragmentary sectional view as sectioned from FIG. 3 to show in greater detail a first length-defining edge of a first spacer element in alignment against the first tape edge of the alignment tape at a first color-coded length segment.

FIG. 3B is an enlarged fragmentary sectional view as sectioned from FIG. 3 to show in greater detail a boundary or border site between first and second color-coded length segments marked upon the alignment tape.

FIG. 3C is an enlarged fragmentary sectional view as sectioned from FIG. 3 to show in greater detail a first length-defining edge of a second spacer element in alignment against the first tape edge of the alignment tape at a second color-coded length segment.

DETAILED DESCRIPTION OF THE PREFERRED EMBODIMENTS AND METHODOLOGY

Figure 11:
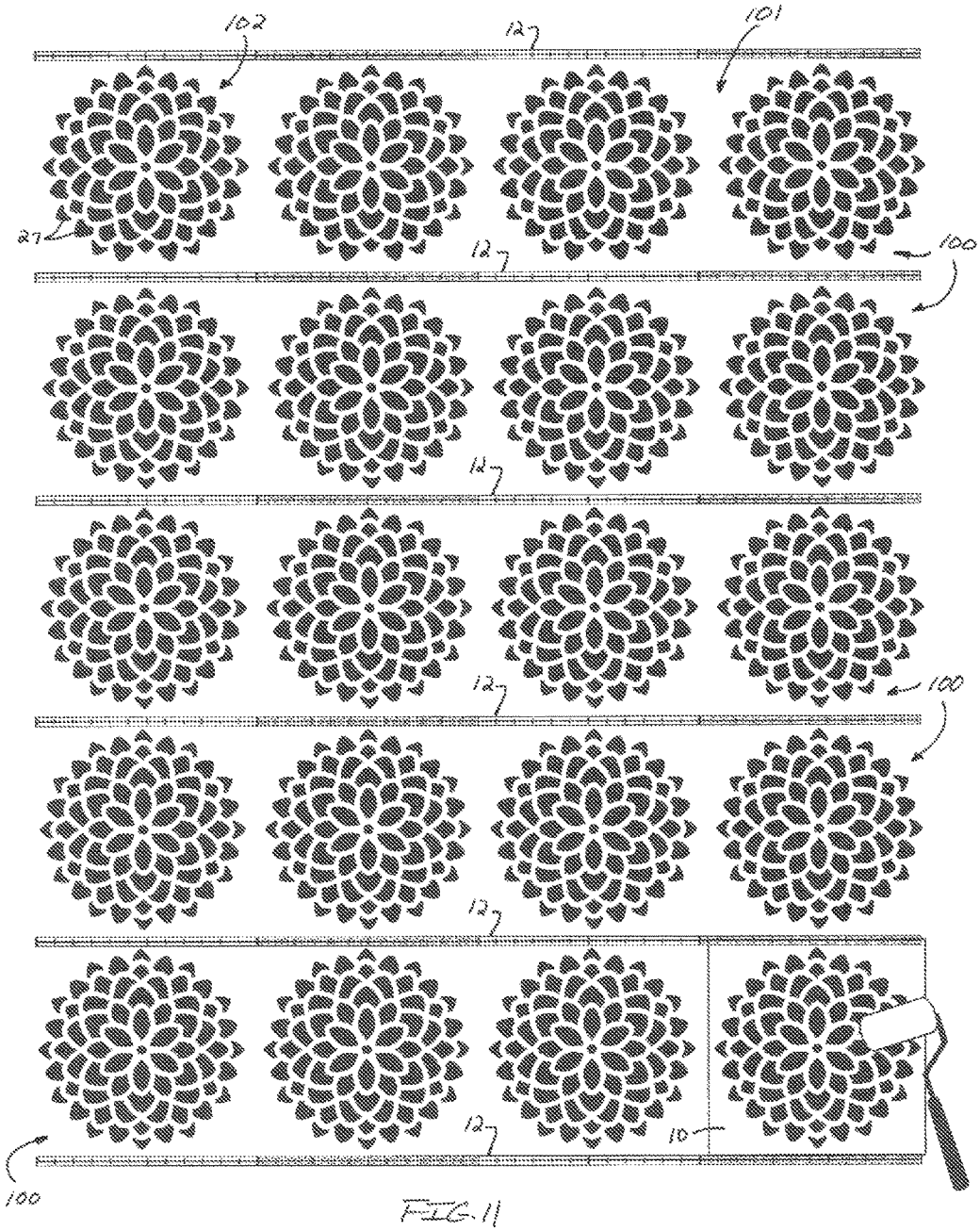
FIG. 11 is a ninth sequential diagrammatic depiction of a ninth stenciling method step according to the present invention depicting the series of lengths of alignment tape, the stencil template being re-positioned at a final pattern position and a marking material implement shown to indicate a marking material having been directed through stencil apertures of the stencil template positioned at the final pattern position.
Figure 12:
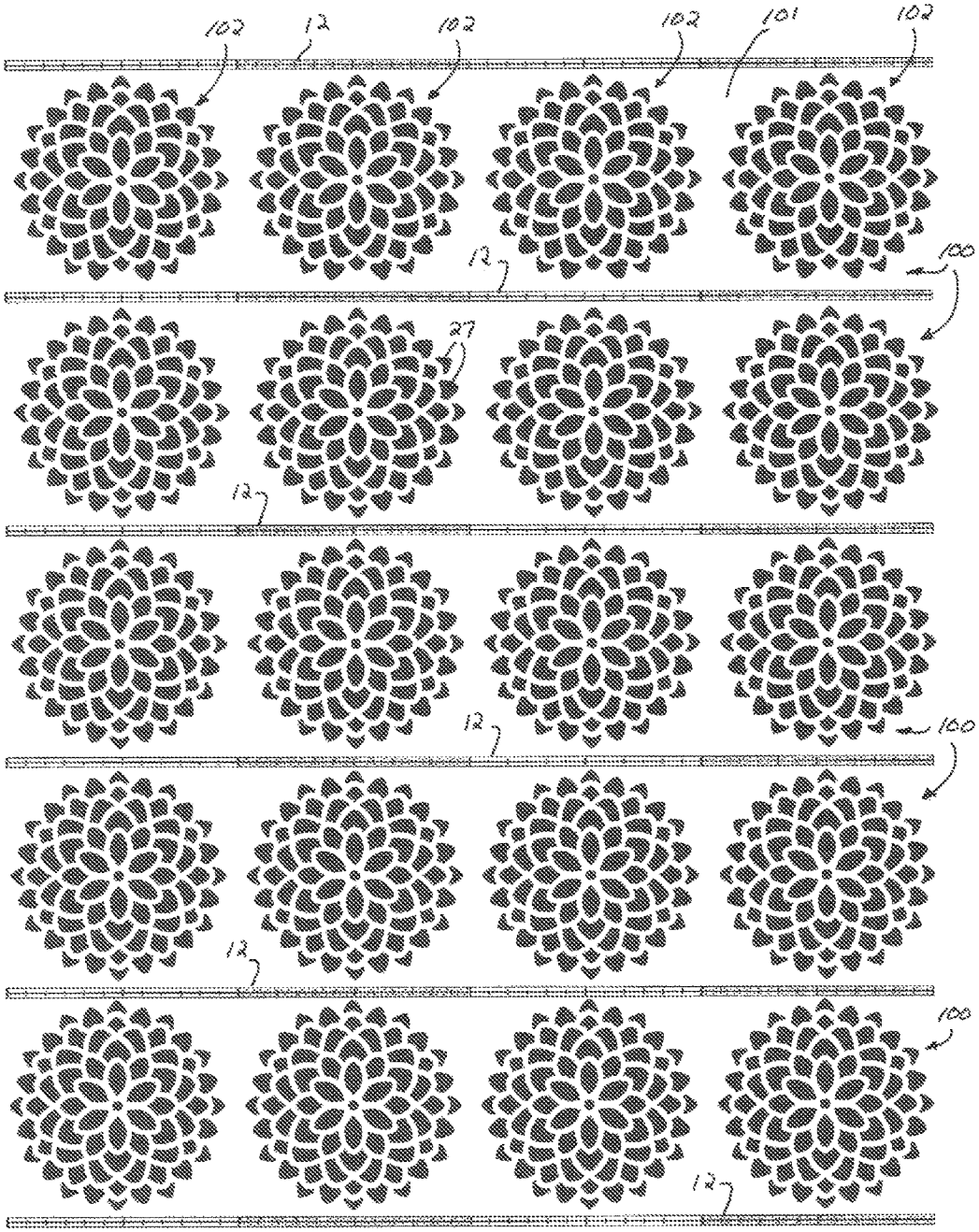
FIG. 12 is a tenth sequential diagrammatic depiction of a tenth stenciling method step according to the present invention depicting the series of lengths of alignment tape, the stencil template being removed from the final pattern position to show a complete set of repeat patterns marked upon the underlying surface via the stencil kit and method according to the present invention.
Figure 13:
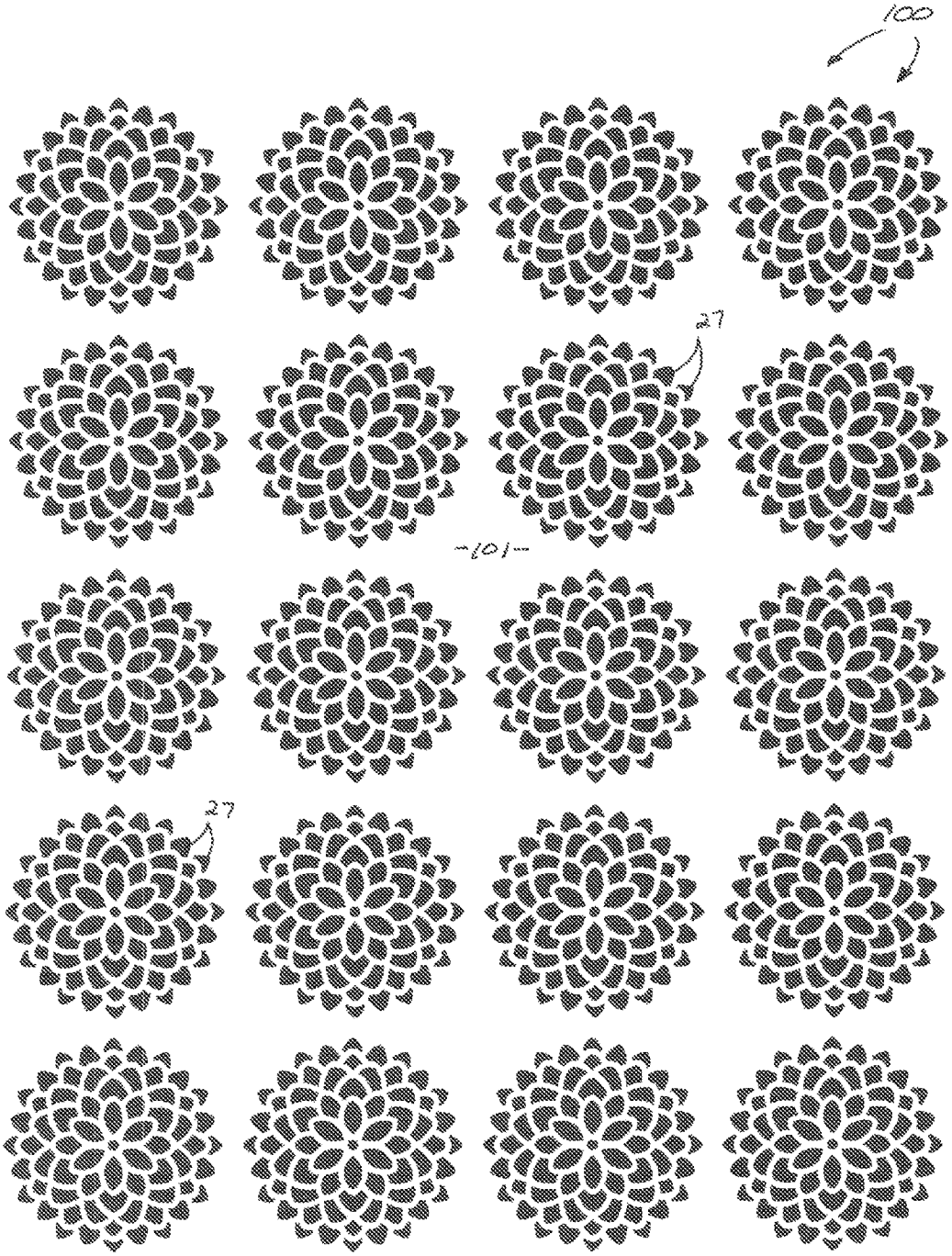
FIG. 13 is an eleventh sequential diagrammatic depiction of an eleventh stenciling method step according to the present invention depicting the series of lengths of alignment tape having been removed to show the complete set of repeat patterns marked upon the underlying surface via the stencil kit and method according to the present invention.

Referring now to the drawings with more specificity, in view of the foregoing brief descriptions, it will be understood that the present invention preferably provides a surface marking system, kit, and method for enabling a user to mark a repeat or repeating pattern 100 upon an underlying surface 101 as generally and comparatively depicted in FIGS. 11-13. In a preferred embodiment, the kit may be said to include a stencil body or template as at 10, and an in an alternative embodiment, the kit may be said to include a decal body as at 50. Both a stencil body 10 and a decal body 50 may be structurally regarded or defined as types of marking material transfer bodies.

Figure 16:
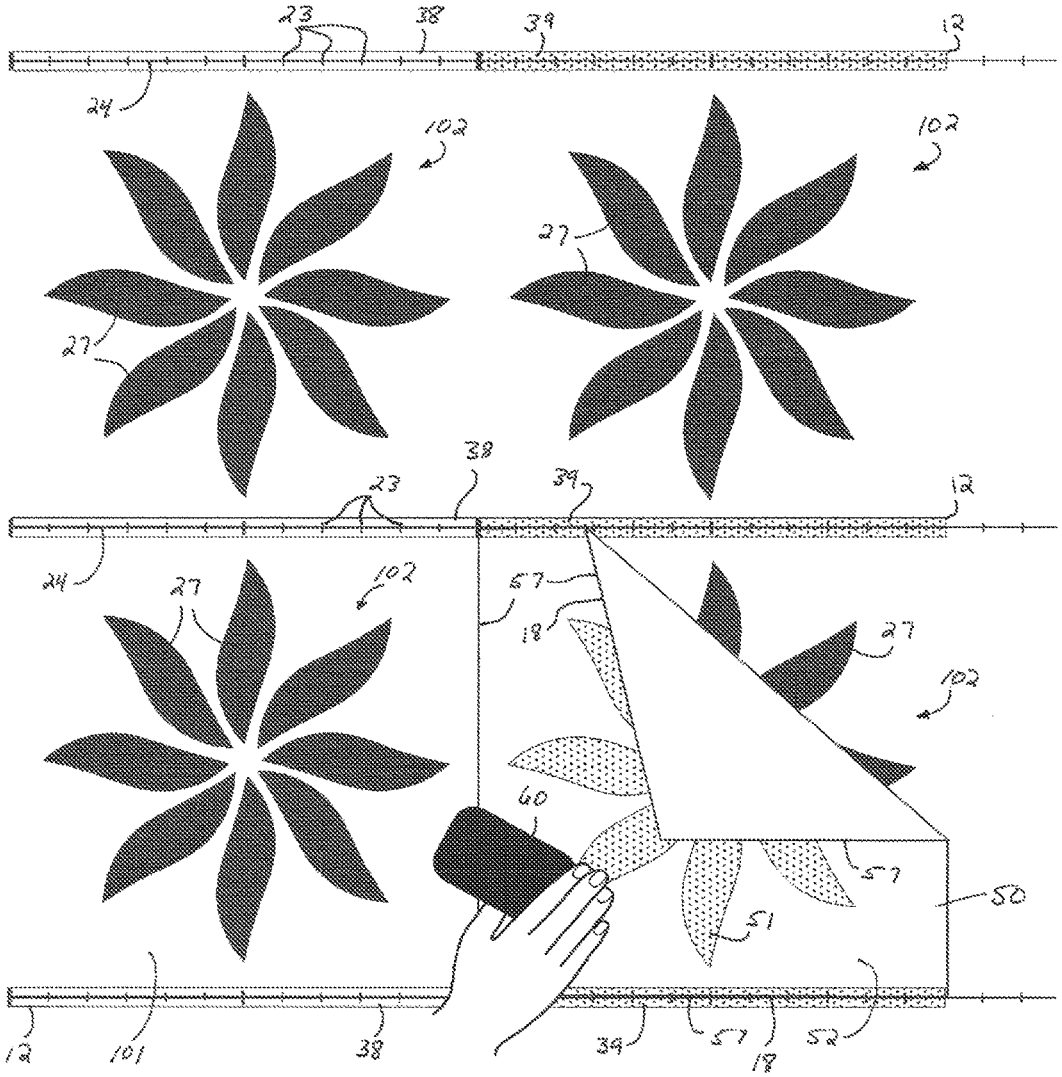
FIG. 16 is a diagrammatic depiction of a first alternative method according to the present invention depicting a series of lengths of alignment tape with a decal body being removed from a fourth pattern position and a marking material deposit being left on the underlying surface to form a repeat pattern.

A repeat or repeating pattern 100 may preferably comprise a series of individual patterns as at 102, which individual patterns 102 by directing a marking material such as paint through stencil apertures 11 formed in the stencil template 10. In the case of a decal body 50, the marking material is directed onto an underlying surface 101 by way of pressure application to the decal surface 52 on the reverse side of marking material portions 51 (e.g. via a manually operable application tool 60), which marking material portions 51 oppose the underlying surface 101 and deposit a decal type marking material 27. The application of pressure thus operates to deposit the (patterned) marking material 27 on the underlying surface as generally depicted in FIG. 16. The underlying surface 101 is believed preferably exemplified by a wall as might be found in a home or place of business or any surface upon which the user desires to locate the repeat pattern 100.

The preferred stenciling system and kit (as at kit 40) may be said to preferably comprise, in combination a rectangular stencil template as at 10, a particularly marked alignment tape 12, which tape is preferably provided in rolled form as at 13; and a series of spacer elements as at 14. The rectangular stencil template 10 exemplified in these specifications and the illustrations submitted in support thereof has been presented as a square stencil template 10, but need not be limited to a square shape. The alternative decal system and kit according to the present invention may be said to preferably comprise, in combination a rectangular decal body as at 50, a particularly marked alignment tape as at 12, which tape 12 is preferably provided in rolled form as at 13; and a series of spacer elements as at 14.

The stencil body or template 10 according to the present invention preferably and essentially comprises a fixed stencil height as at 15; a fixed stencil width as at 16; an outer stencil perimeter 17; and at least one, but preferably a series of patterned stencil apertures 11. The outer stencil perimeter 17 comprises opposed, parallel mark-alignment edges as at 18, and the fixed stencil height 15 is measurable intermediate the mark-alignment edges 18. The stencil apertures 11 are located inwardly of the outer stencil perimeter 17.

The decal body 50 according to the present invention preferably and essentially comprises a fixed decal height as at 55; a fixed decal width as at 56; an outer decal perimeter as at 57; and at least one, but preferably a series of patterned marking material portions as at 51. The decal body 50 is thus essentially the same as or similar to the stencil body in rectangular form, the primary structural difference being the means for enabling material transfer to the underlying surface 101. In this regard, it will be seen that the outer decal perimeter 57 comprises opposed, parallel mark-alignment edges as at 18, and the fixed decal height 55 is measurable intermediate the mark-alignment edges 18. The marking material portions 51 are located inwardly of the outer decal perimeter 57.

The stencil or body alignment tape 12 is preferably provided in rolled form 13 and comprises a fixed tape width as at 19; a variable, unrollable tape length as at 20; an adhesively coated posterior tape surface as at 21; and a periodically and uniformly marked anterior tape surface as at 22. In other words, the user may unroll a length 20 of the stencil or body alignment tape 12 as may be required and as generally depicted throughout the drawings submitted in support of these specifications. The periodically and uniformly marked anterior tape surface 22 preferably comprises a series of periodic and uniformly spaced width-wise marks as at 23 and a length-wise mark as at 24. The length-wise mark 24 is centered relative to the fixed tape width 19 for dividing the periodically and uniformly marked anterior tape surface 22 into a first width half as at 25 and a second width half as at 26.

A set or number of sequentially spaced width-wise marks 23 is summed together and the sum of the spacing is preferably made equal to a select template dimension, which select template dimension is selected from the group consisting of the fixed stencil height 15 or body height 55, and the fixed stencil width 16 or body width 56. In this regard, the illustrations submitted in support of these specifications show an exemplary tape layout wherein the width-wise marks 23 are periodically and uniformly spaced at one inch intervals and a group of 12 marks are equal to the fixed stencil width 16 or body width 56 (as well as the fixed stencil height 15 or body height 55 as exemplified by the square template 10 or body 50). Naturally, any type of spacing scheme may be adopted so long as a number of width-wise marks 23, when viewed as a sequential set of marks 23, dimensionally equal either of the widths 16 or 56 or heights 15 or 55 for enhancing positioned placement of the stencil template 10 or decal body 50.

Figure 1:
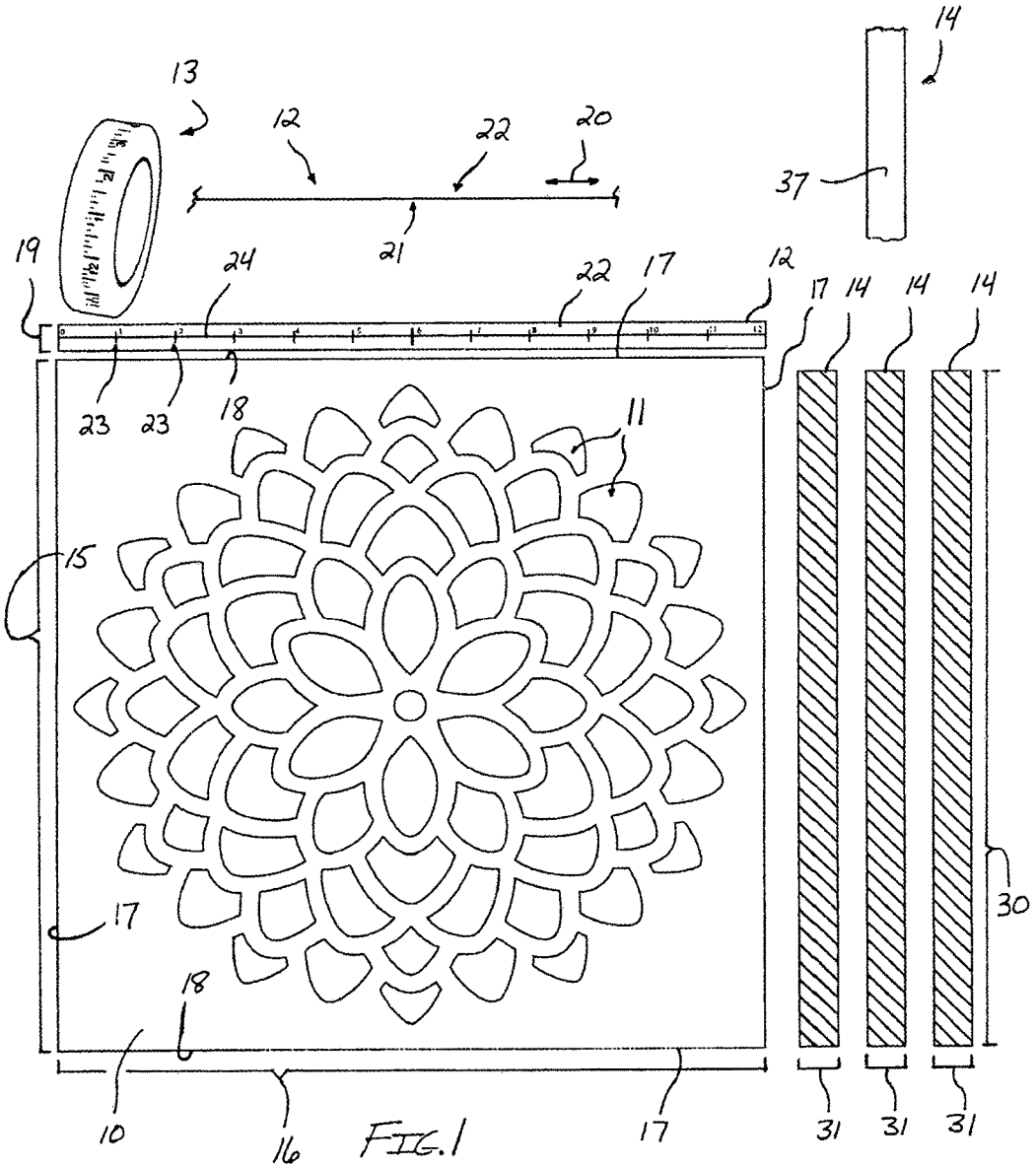
FIG. 1 is an enlarged plan view of kit components according to the present invention, including a stencil template, a length of alignment tape, and three spacer elements.
Figure 1A:
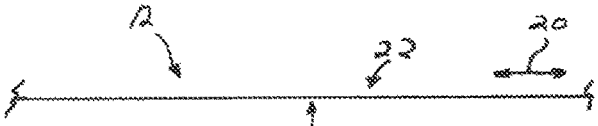
FIG. 1A is a fragmentary edge view of a length of alignment tape according to the present invention.
Figure 1C:
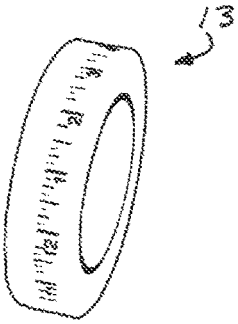
FIG. 1C is a perspective view of alignment tape in rolled form according to the present invention.
Figure 1B:
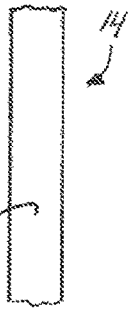
FIG. 1B is a fragmentary posterior surface view of a spacer element according to the present invention.
Figure 1D:
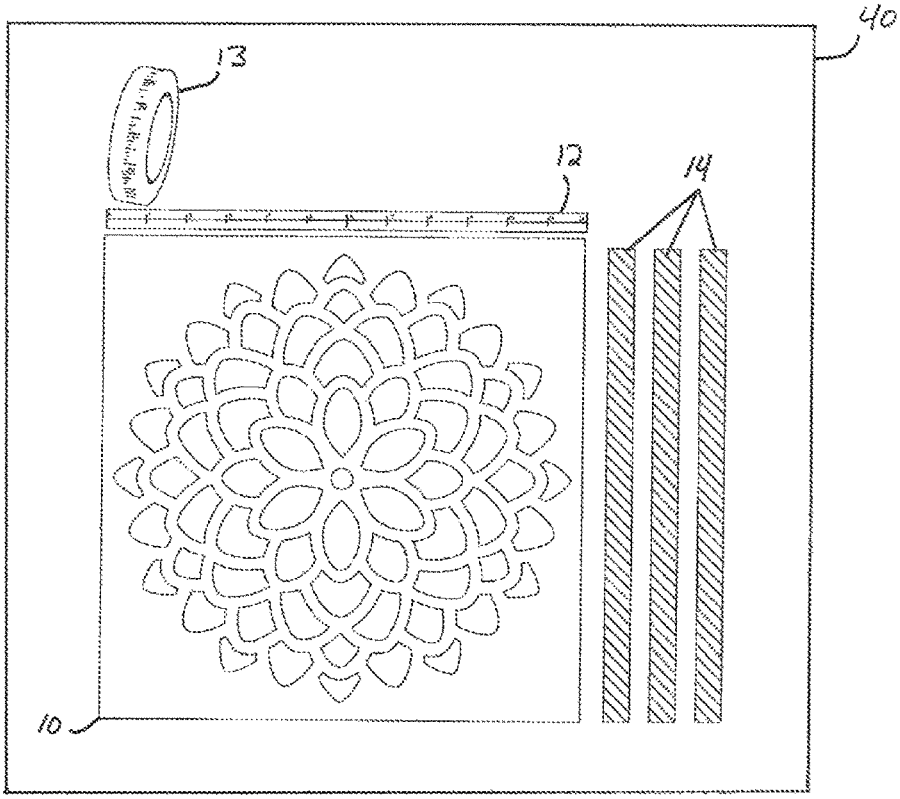
FIG. 1D is a collection of kit components according to the present invention showing the alignment tape in rolled form, alignment tape in anterior plan view, stencil template in anterior plan view, and three spacer elements in anterior plan view.
Figure 2:
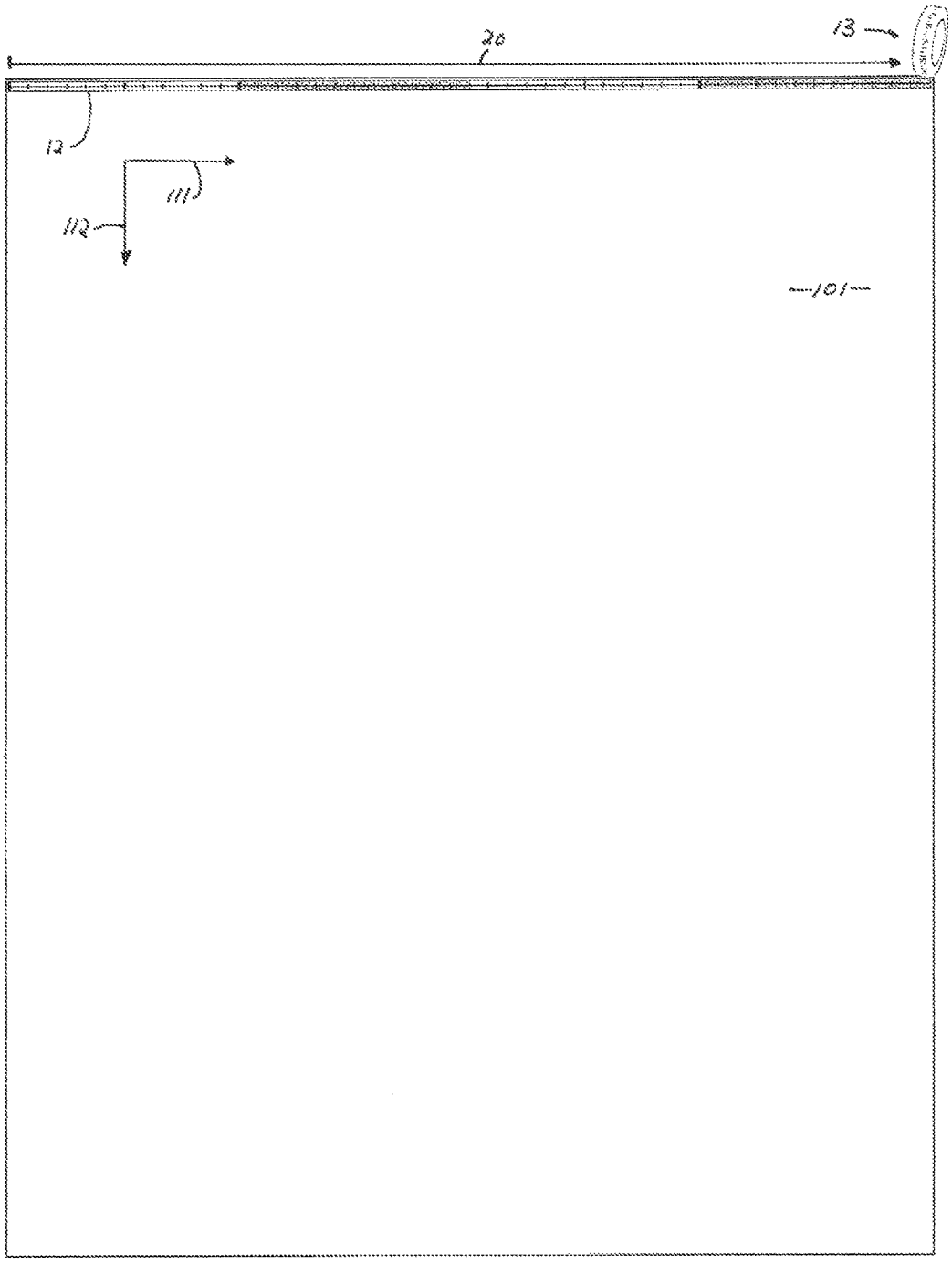
FIG. 2 is a first sequential diagrammatic depiction of a first stenciling method step according to the present invention depicting a first length of alignment tape being unrolled from the rolled form of alignment tape, and removably affixed to an underlying surface and extended in a first direction or dimension.

Referencing FIG. 2, it will there be seen that a first piece or length 20 of alignment tape 12 is removably affixed to a first tape portion of the underlying surface 101 via the adhesively coated posterior tape surface 21 in a first dimension 111 extending in the direction of the variable tape length 20. As prefaced above, the first length of alignment tape 12 should be leveled relative to the horizontal or vertical if the user wishes to maintain a vertical-horizontal grid layout. The step of leveling the first length of alignment tape 12 is not specifically illustrated.

The periodically and uniformly marked anterior tape surface 22 may further preferably comprise color-coded length segments. Referencing FIG. 3B, the reader will there particularly note a first color-coded length segment depicted with white coloration as at 38 and a second color-coded length segment is depicted with stippled coloration as at 39. The color-coded length segments 38 and 39 are preferably equal in length to the select template dimension (e.g. the template or body widths 16/56) for enhancing a user's ability to successively position the select template dimension relative to the periodically and uniformly marked anterior tape surface 22.

To firstly position the stencil template 10, the select template dimension (e.g. template width 16) is (a) firstly positionable at a first select number of sequentially spaced width-wise marks 23 and a first mark-alignment edge 18 of the opposed, parallel mark-alignment edges 18 of the outer stencil perimeter 17 is firstly alignable with the first length-wise mark 24. The stencil aperture(s) 11 function to let a marking material 27 (such as paint or a decal material) through the plane of the rectangular stencil template 10 for marking a first design or pattern 102 reflective of the at stencil apertures 11 upon the underlying surface 101. A depiction of a paint roller assembly 28 is presented to depict the transfer of marking material 27 through the stencil apertures 11, a practice believed to be well known or understood according to the art.

Figure 8:
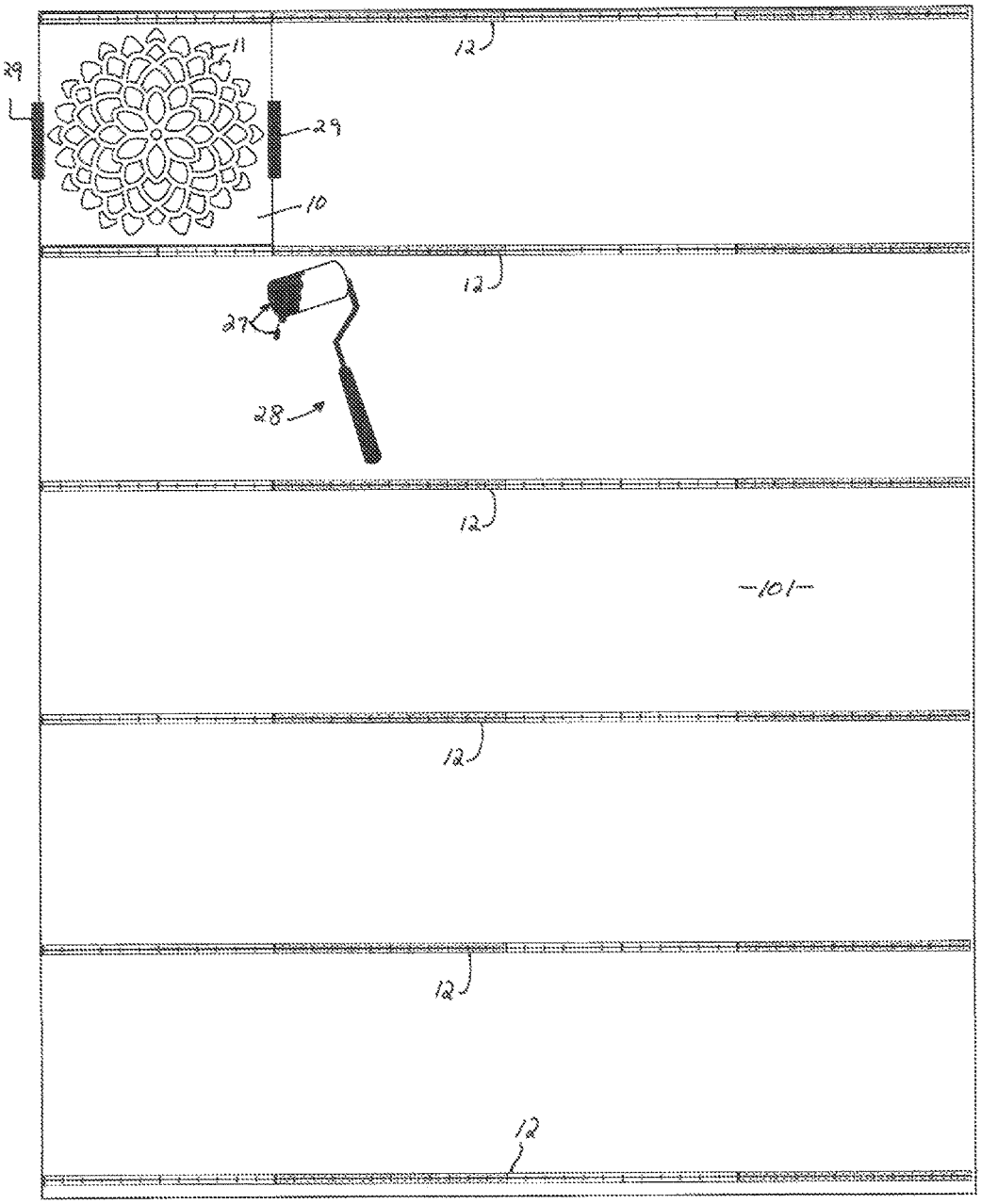
FIG. 8 is a seventh sequential diagrammatic depiction of a seventh stenciling method step according to the present invention depicting the series of lengths of alignment tape, the stencil template being temporarily affixed to the underlying surface and a marking material about to be directed through stencil apertures of the stencil template positioned at the first pattern position.
Figure 9:
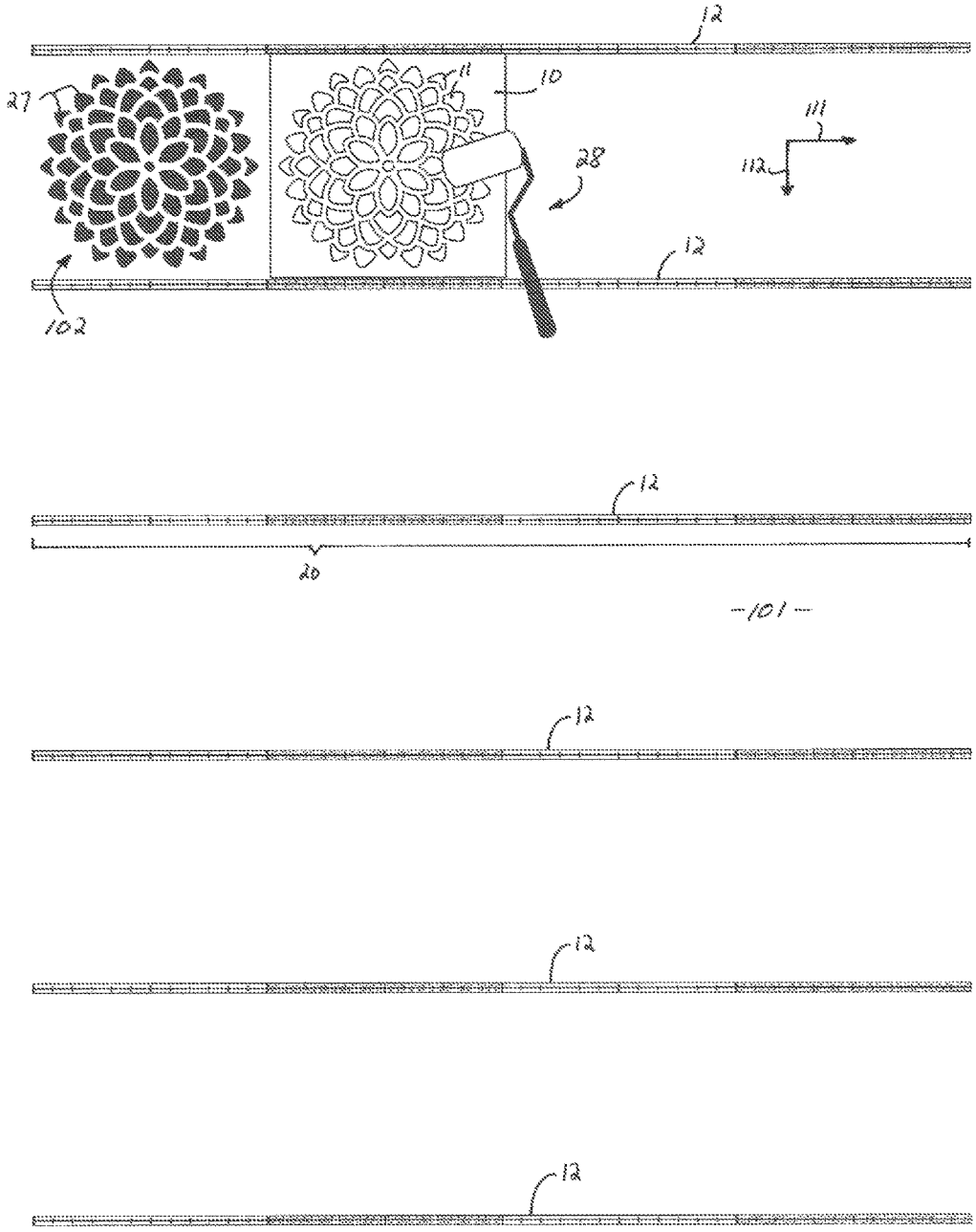
FIG. 9 is an eighth sequential diagrammatic depiction of a first alternative eighth stenciling method step according to the present invention depicting the series of lengths of alignment tape, the stencil template being re-positioned at a successive pattern position and a marking material implement shown to indicate a marking material about to be directed through stencil apertures of the stencil template positioned at the successive pattern position, marking material having been marked upon the underlying surface at the first pattern position.
Figure 10:
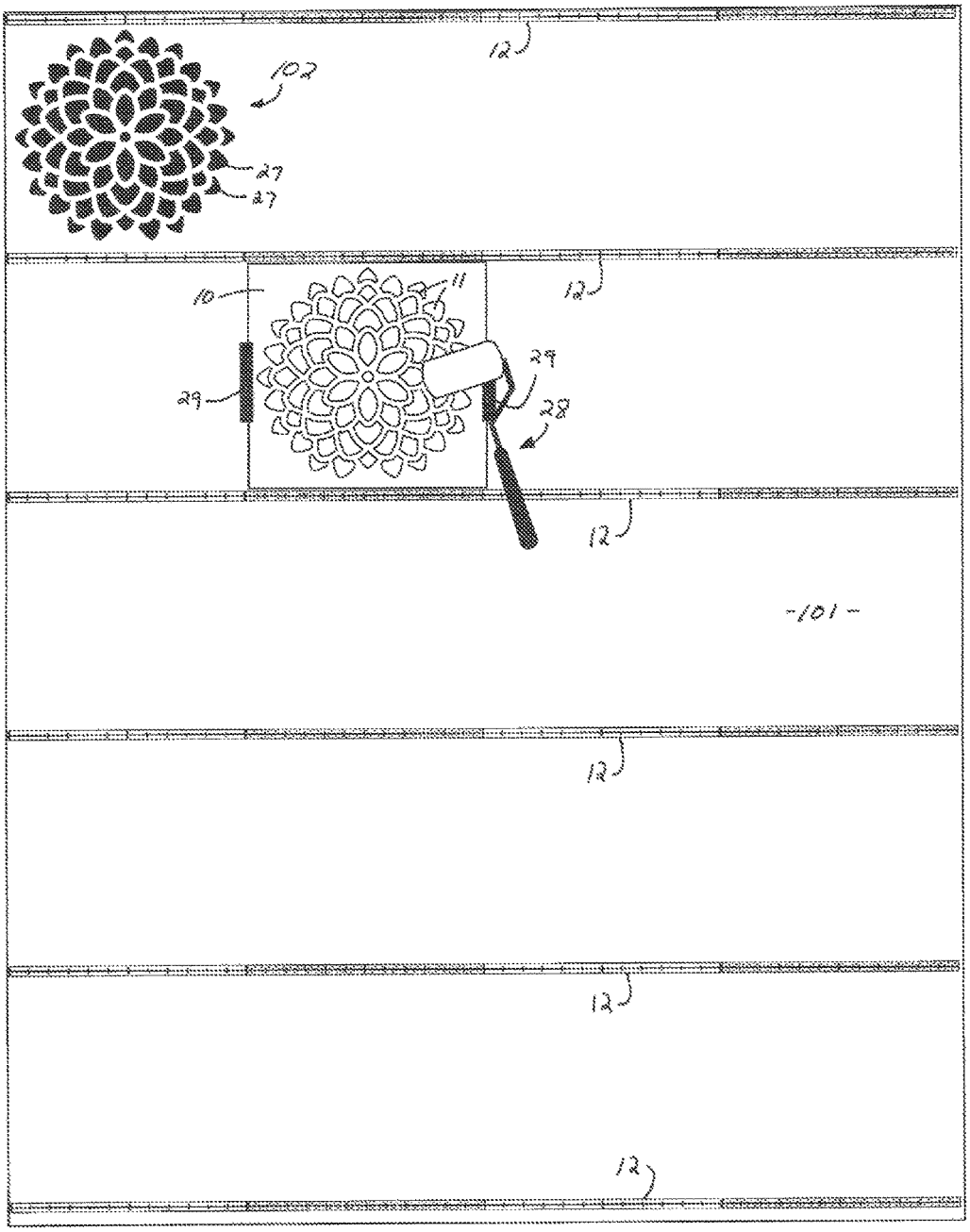
FIG. 10 is an eighth sequential diagrammatic depiction of a second alternative eighth stenciling method step according to the present invention depicting the series of lengths of alignment tape, the stencil template being re-positioned at a successive pattern position and a marking material implement shown to indicate a marking material about to be directed through stencil apertures of the stencil template positioned at the successive pattern position, marking material having been marked upon the underlying surface at the first pattern position.

The stencil template 10 may be temporarily held in material-letting position via tape strips 29 so that the user may more readily apply the marking material 27 to the underlying surface 101 via the stencil apertures 11 as generally depicted in FIGS. 8 and 10. To successively position the stencil template 10, the stencil template 10 is successively positionable at successive select numbers of sequentially spaced width-wise marks 23 such that the first mark-alignment edge 18 is successively alignable with the first length-wise mark 24. The stencil apertures 11 again function to let the marking material 27 through the stencil template 10 for marking successive designs or patterns 102 upon the underlying surface 101 to form a repeat pattern 100 of designs or patterns reflective of the stencil apertures 11. In this manner, the repeat pattern 100 of designs or patterns may be extended in the first dimension or direction 111 as generally depicted in FIG. 9.

The spacer elements 14 each preferably comprise a spacer length as at 30 and a spacer width as at 31. The spacer lengths 30 are preferably equal to the fixed stencil height 15 less or minus the fixed tape width 19. If, for example, the fixed tape width were 0.5 inches in dimension (and the first and second half widths are each 0.25 inches in dimension), and the fixed stencil height 15 were 12 inches in dimension, then the preferred spacer length 30 would be 11.5 inches in dimension. Each successive piece or length 20 of alignment tape 12, being from the same rolled form 13, is substantially identical to the first piece or length of alignment tape 12, and thus each successive alignment tape 12 comprises a successive length-wise mark 24 for alignment in parallel relation to the first length-wise mark 24.

Figure 14A:
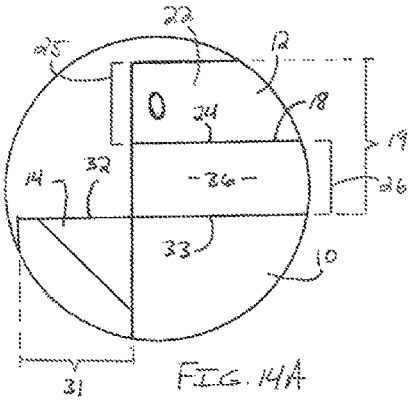
FIG. 14A is a first enlarged, fragmentary sectional view as sectioned from FIG. 14 to depict in greater detail the junction site between the first length of alignment tape, a first length-defining edge of the spacer element, and the stencil template.
Figure 14B:
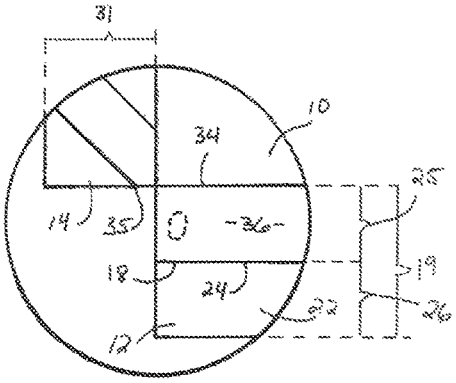
FIG. 14B is a second enlarged, fragmentary sectional view as sectioned from FIG. 14 to depict in greater detail the junction site between the successive length of alignment tape, a second length-defining edge of the spacer element, and the stencil template.
Figure 14:
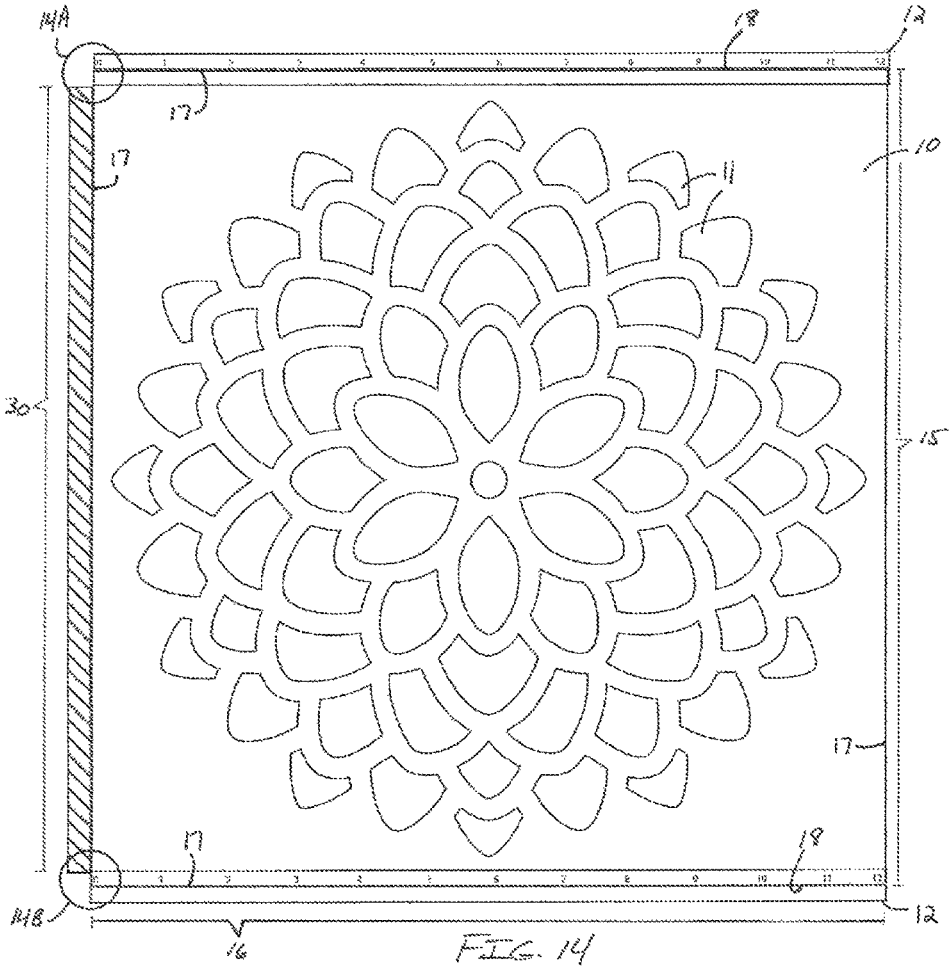
FIG. 14 is an enlarged plan view of certain preferred kit components according to the present invention showing a stencil template with flower petal-patterned apertures in positioned placement relative to first and successive lengths of alignment tape with a single spacer element extending between the first and successive lengths of alignment tape.
Figure 15:
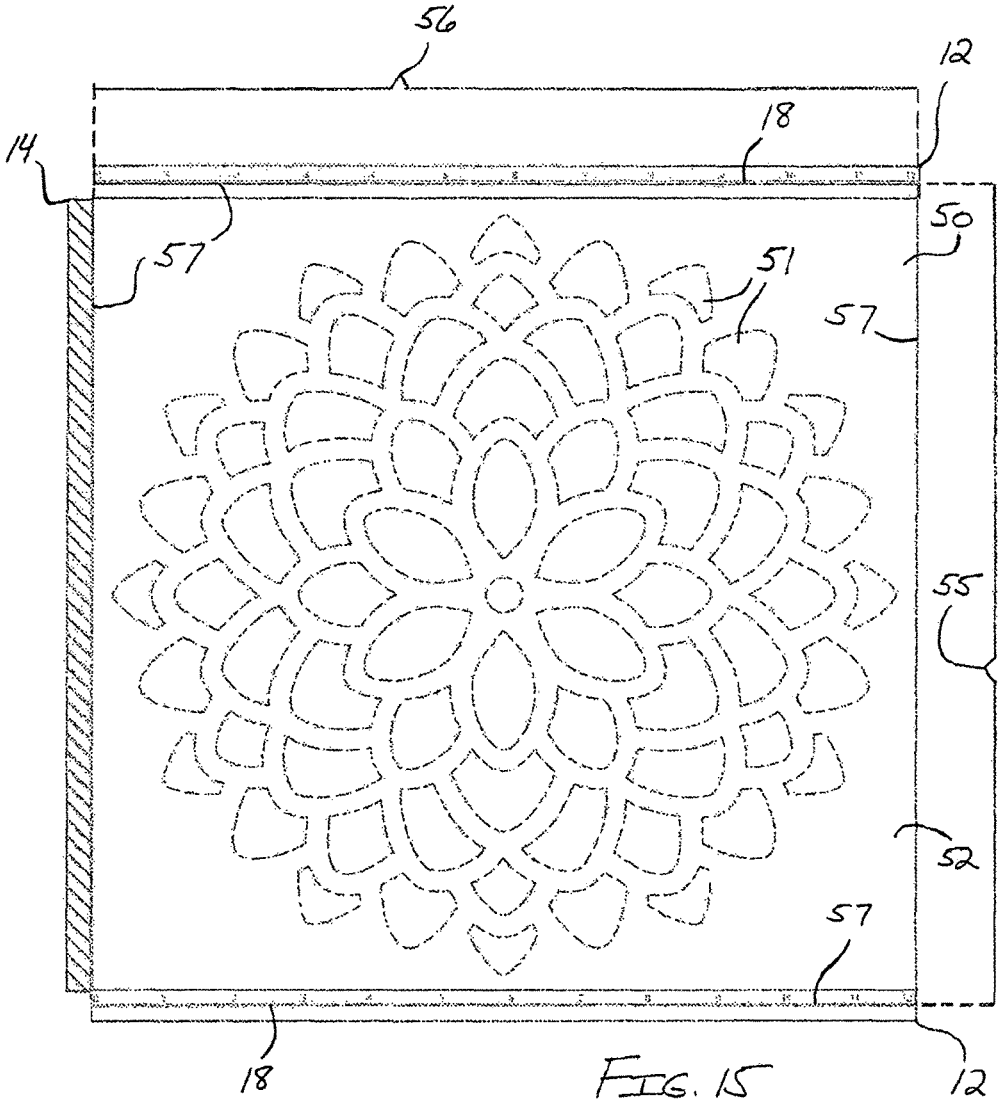
FIG. 15 is an enlarged plan view of certain alternative kit components according to the present invention showing a rectangular decal body with flower petal-patterned material transfer portions shown in hidden, broken lining in positioned placement relative to first and successive lengths of alignment tape with spacer elements extending between the first and successive lengths of alignment tape.

A first length-defining edge 32 of each spacer element 14 is alignable at a select width-wise edge 33 of the first alignment tape 12 as affixed to the first tape portion of the underlying surface 101. The spacer elements 14 are all extended in a second dimension or direction 112 orthogonal to the first dimension or direction 111. A successive alignment tape 12 is aligned in parallel relation relative to the first alignment tape 12 and an opposing width-wise tape edge 34 (i.e. a tape edge 34 that opposes the first width-wise tape edge 33) of the successive alignment tape 12 is aligned at a second length-defining edge 35 of each spacer element 14 such that the opposed, parallel mark-alignment edges 18 are aligned with the first and successive length-wise marks 24. The rectangular stencil template 10 thus overlaps the first and successive alignment tapes 12 at overlap sections 36 in adjacency to the opposed, parallel mark-alignment edges 18 as perhaps most clearly depicted in FIGS. 14-14B. Given the exemplary dimensions hereinabove, the overlap sections 36 would thus measure 12 inches by 0.25 inches.

Figure 4:
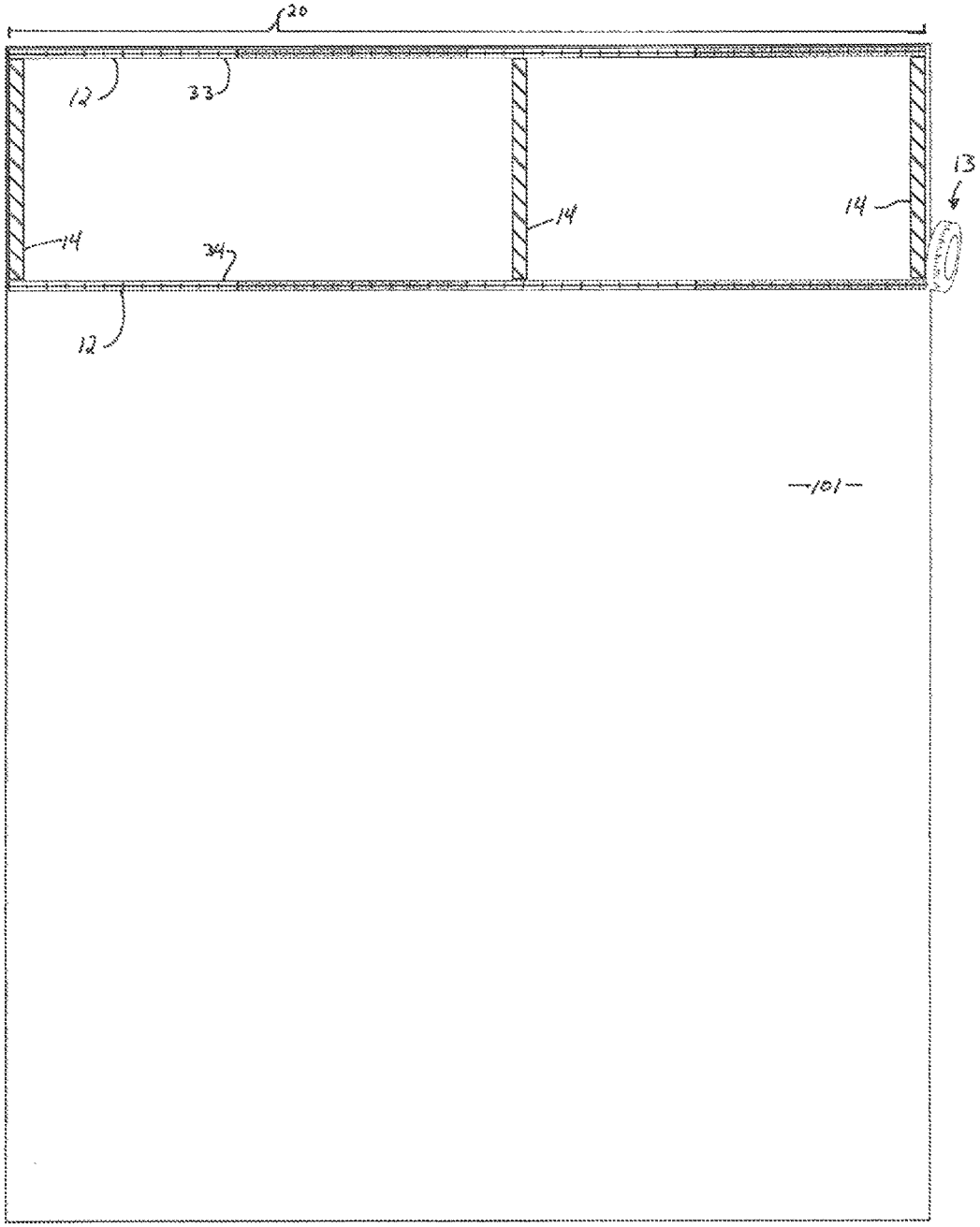
FIG. 4 is a third sequential diagrammatic depiction of a third stenciling method step according to the present invention depicting a successive length of alignment tape being aligned at the second length-defining edges of the series of spacer elements, the successive length of alignment tape being extended in parallel relation to the first length of alignment tape in the first direction or dimension upon the underlying surface.
Figure 5:
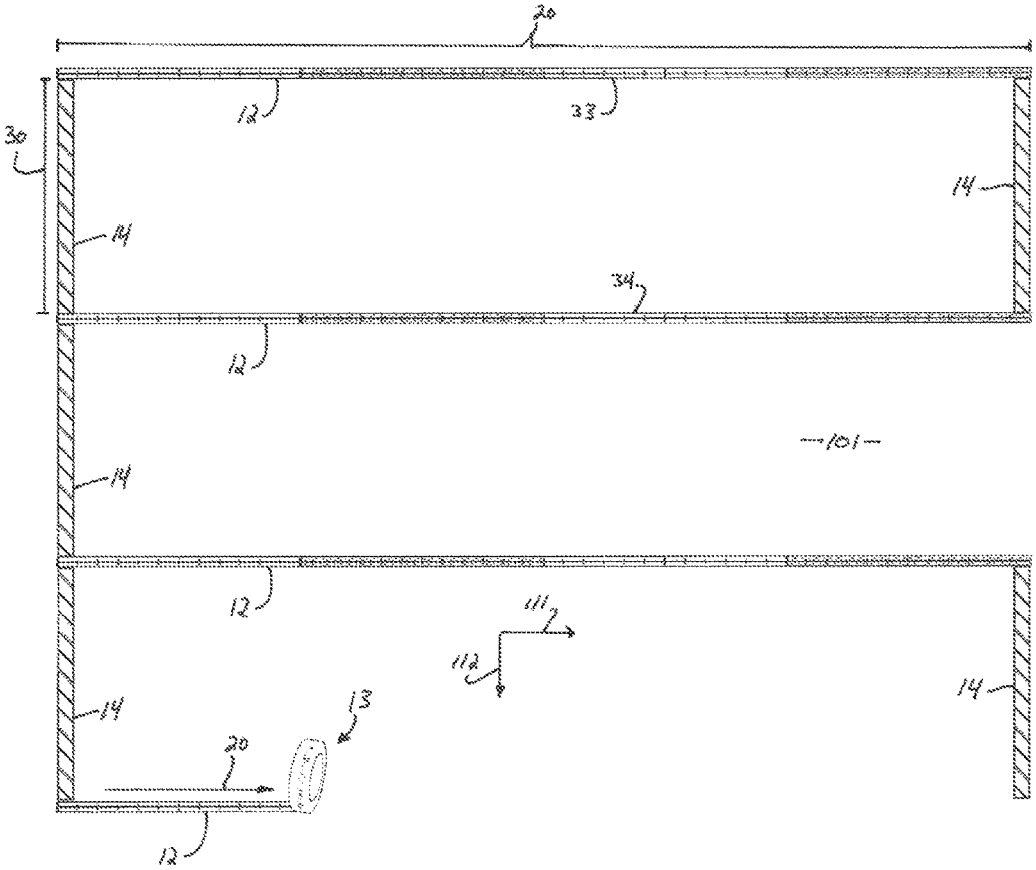
FIG. 5 is a fourth sequential diagrammatic depiction of a fourth stenciling method step according to the present invention depicting successive lengths of alignment tape being aligned by way of a series of spacer elements, the successive lengths of alignment tape being extended in parallel relation to the first length of alignment tape in the first direction or dimension.
Figure 6:
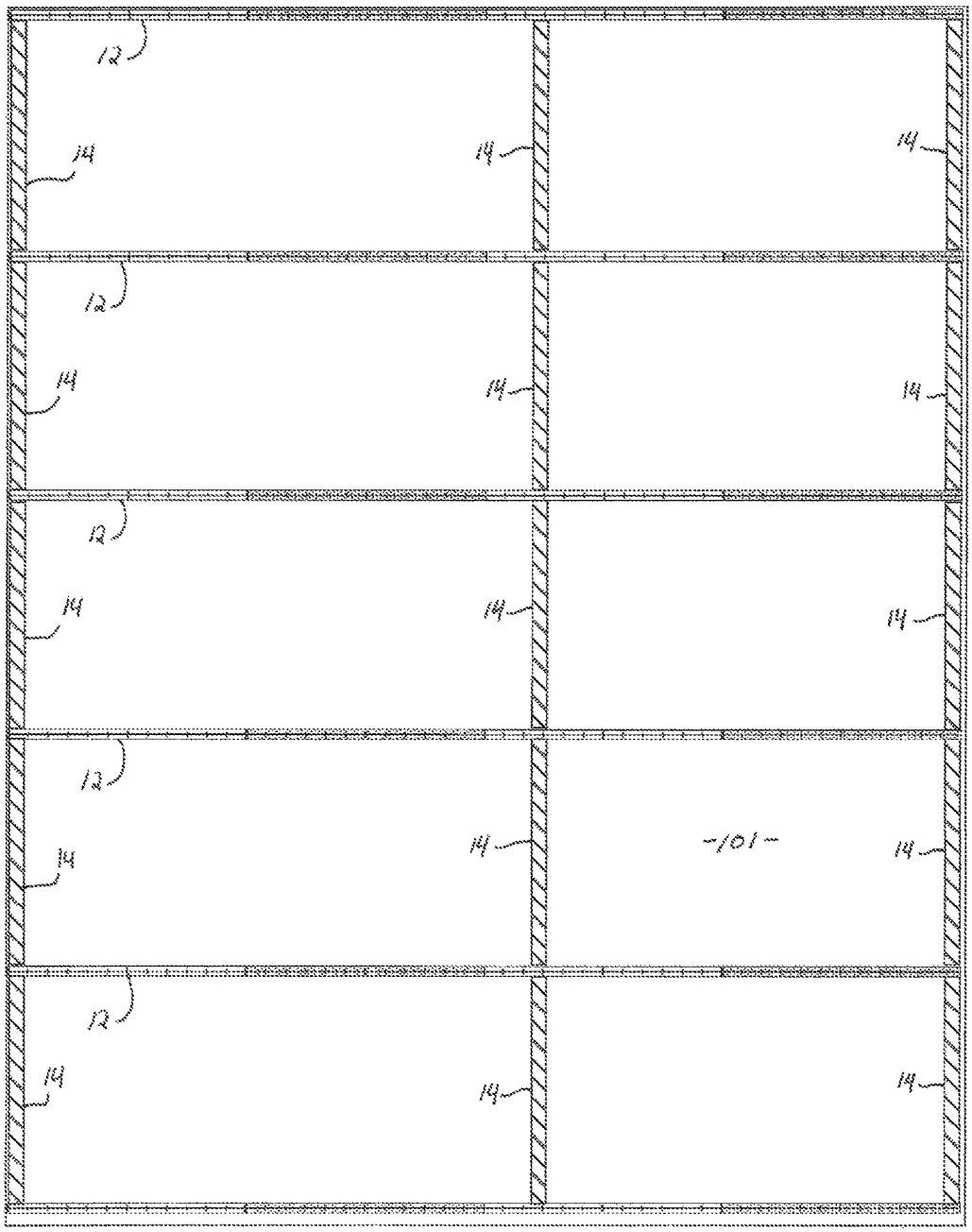
FIG. 6 is a fifth sequential diagrammatic depiction of a fifth stenciling method step according to the present invention depicting the series of lengths of alignment tape aligned by way of a series of spacer elements, the series of lengths of alignment tape all extended in parallel relation relative to one another in the first direction or dimension upon the underlying surface.
Figure 7:
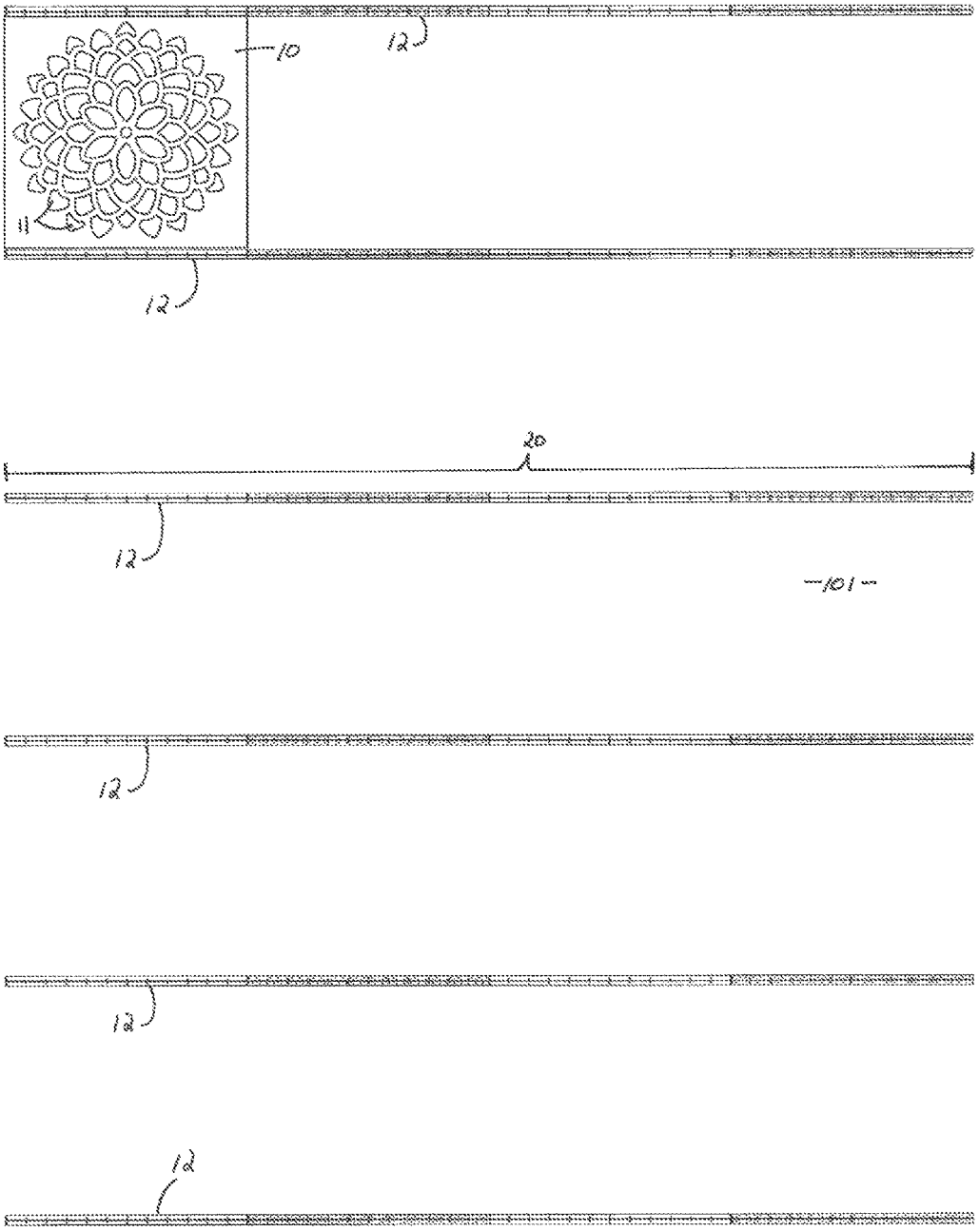
FIG. 7 is a sixth sequential diagrammatic depiction of a sixth stenciling method step according to the present invention depicting the series of lengths of alignment tape with spacer elements removed, the series of lengths of alignment tape all extended in parallel relation relative to one another in the first direction or dimension upon the underlying surface, and a stencil template being positioned at a first pattern position.

It is contemplated that the system or kit may preferably provide at least two spacer elements 14 so that the user may align the same in parallel relation to one another for enhancing a user's ability to space the first and successive alignment tapes 12 in parallel relation to one another as generally depicted in FIG. 5. FIGS. 3, 4, and 6, by contrast show the use of three spacer elements, all of which are aligned in parallel relation to one another and are of equal spacer length 30 for enhancing the parallel positioned placement of the alignment tapes 12 relative to one another.

Further, each spacer element 14 preferably comprises spacer width 31, which spacer widths 31 at the first and second length-defining edges 32 and 35 enhance the user's ability to space the alignment tapes 12 in parallel relation to one another. In other words, the edges 32 and 35, each having a width dimension (extending in the first dimension or direction 111), may be aligned with the tape edges 33 and 34 for enhancing the user's ability to extend the spacer elements 14 orthogonally relative to the alignment tapes 12. Each spacer element 14 may further preferably comprise an adhesively coated posterior spacer surface as at 37 for enabling the user to removably attach each spacer element 14 to spacer portions of the underlying surface 101.

While the above descriptions contain much specificity, this specificity should not be construed as limitations on the scope of the invention, but rather as an exemplification of the invention. The basic invention may be said to essentially teach or disclose a surface marking system, kit, and method for enabling a user to mark a (repeat) pattern upon an underlying surface. The surface marking system and/or kit may be said to cover both a stenciling system and a decal transfer system and thus essentially comprises a marking material transfer body, at least one length of alignment tape, and at least one spacer element.

The marking material transfer body is essentially rectangular, and in certain preferred embodiments may be provided in a square shape comprising a fixed body height, a fixed body width, an outer body perimeter, a body plane, and at least one, but typically a number of marking material portions. In the case of a stencil, the marking material portions are stencil apertures as at 11. In the case of a decal, the marking material portions are areas holding or providing pressure-applicable marking material (as at 27). The outer body perimeter comprises opposed, parallel mark-alignment edges. The fixed body height is measured intermediate the opposed, parallel mark-alignment edges.

The alignment tape has a fixed tape width, a selectively variable tape length, an adhesively coated posterior tape surface, and a periodically and uniformly marked anterior tape surface. The periodically and uniformly marked anterior tape surface comprises a series of periodic and uniformly spaced width-wise marks and a length-wise mark. The length-wise mark is centered relative to the fixed tape width for dividing the periodically and uniformly marked anterior tape surface into a first width half and a second width half.

A number of sequentially spaced width-wise marks are summarily spaced so as to equal a select template dimension. The select template dimension is selected from the group consisting of the fixed body height and the fixed body width. The alignment tape is removably affixable to a first tape portion of the underlying surface via the adhesively coated posterior tape surface in a first dimension extending in the direction of the variable tape length. The periodically and uniformly marked anterior tape surface may preferably comprise color-coded length segments equal in length to the select template dimension for enhancing a user's ability to successively position the select template dimension relative to the periodically and uniformly marked anterior tape surface.

The select template dimension (e.g. the fixed stencil width) is firstly positionable at a first select number of sequentially spaced width-wise marks, and a first of the mark-alignment edges is firstly alignable with the length-wise mark. The user may optionally affix the stencil template or decal body in positioned placement with separate tape lengths. The marking material portions operate to transfer a marking material to the underlying surface. In the case of stencil aperture(s) 11, said apertures 11 let a marking material, separately applied, through the plane of the rectangular stencil template for marking a first pattern reflective of the stencil aperture(s) upon the underlying surface. In the case of marking material portions 51, pressure applied to the reverse side of the portions operates to deposit or transfer the marking material to the underlying surface.

The select template dimension (e.g. the fixed stencil width) is successively positionable or re-positionable at successive select numbers of sequentially spaced width-wise marks, and the first of the mark-alignment edges is successively alignable with the first length-wise mark. The marking material portions operate to transfer marking material via the marking material transfer body for marking successive patterns upon the underlying surface to form a repeat pattern reflective of the marking material portions, the repeat pattern extending in the first dimension or direction.

As indicated, the kits according to the present invention may further preferably and optionally comprise at least one spacer element and at least one successive alignment tape for forming a second row of repeat pattern in the second dimension or direction relative to the first row of repeat pattern. Each spacer element preferably comprises a spacer length. The spacer length is equal to the fixed stencil height less the fixed tape width. Each successive alignment tape is substantially identical to the firstly used alignment tape, and thus each alignment tape comprises a successive length-wise mark for alignment in parallel relation to the first length-wise mark.

A first length-defining edge of the at least one spacer element is alignable at a select first tape edge of the first alignment tape as affixed to the first tape portion of the underlying surface. The spacer elements are extendable in a second dimension orthogonal to the first dimension. Each successive alignment tape being alignable in parallel relation relative to the first alignment tape. An opposing tape edge (i.e. a tape edge that opposes the first tape edge) of the successive alignment tape is alignable at a second length-defining edge (opposite the first length-defining edge) of the spacer element(s) such that the opposed, parallel mark-alignment edges of the stencil template or decal body are alignable with the first and successive length-wise marks. The stencil template or decal body thus overlaps the first and successive alignment tapes at overlap sections adjacent the opposed, parallel mark-alignment edges.

The incorporation and/or use of at least two spacer elements is believed preferable so as to enhance the uniformity of spacing between the first and successive lengths of alignment tape. In this regard, it is contemplated that the system and/or kit preferably include at least two or more spacer elements alignable in parallel relation to one another for enhancing a user's ability to space the first and successive alignment tapes in parallel relation to one another.

Each spacer element may further preferably comprise a spacer width such that the spacer widths at the first and second length-defining edges are alignable with the edging of opposed alignment tape lengths for enhancing the user's ability to space the first and successive alignment tape lengths in parallel relation to one another. Each spacer element, similar to the alignment tape, may preferably comprise an adhesively coated posterior spacer surface for enabling the user to removably attach each spacer element to spacer portions of the underlying surface.

Figure 17:
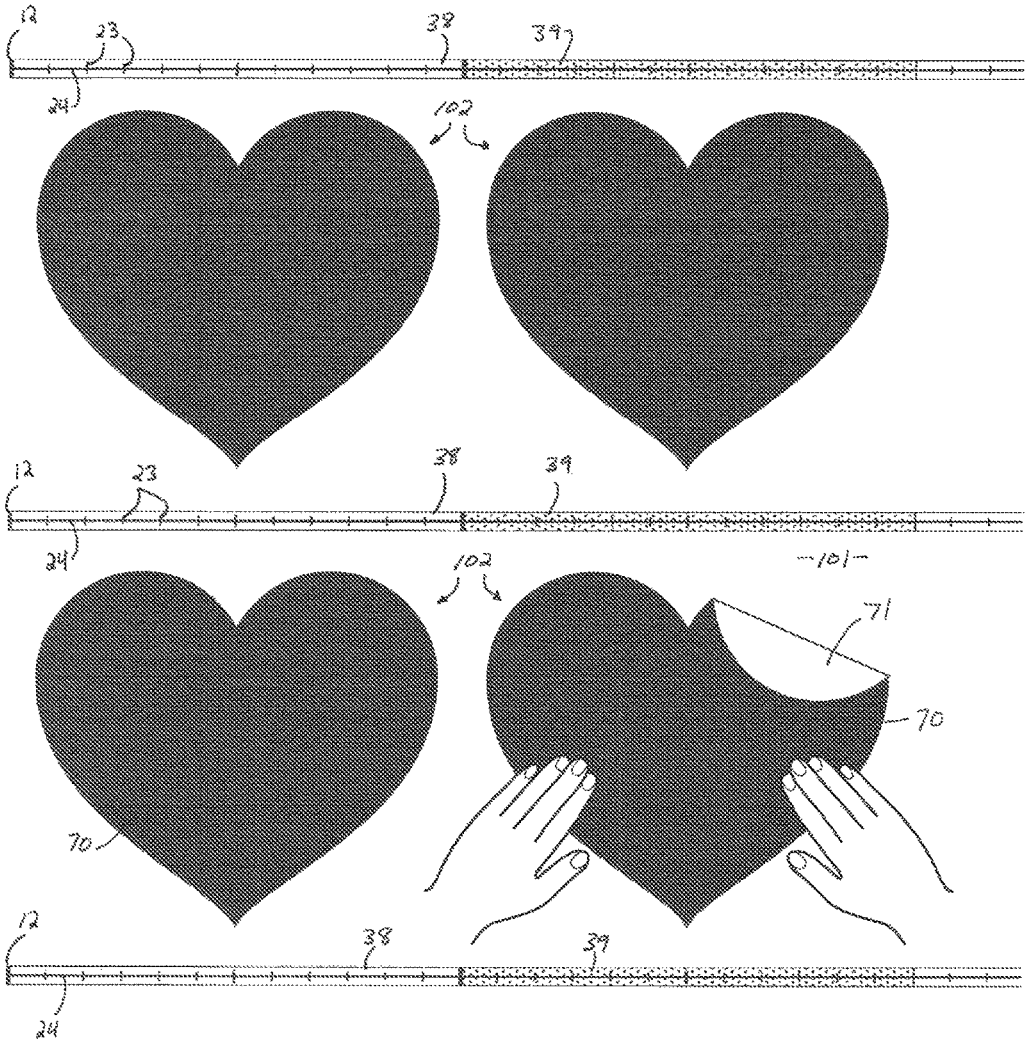
FIG. 17 is a diagrammatic depiction of a second alternative method according to the present invention depicting a series of stickers being positioned and adhesively attached to the underlying surface for forming a repeat pattern.

Referencing FIG. 17, the reader will there consider a further diagrammatic iteration of the system or kit according to the present invention. The core or essence of the present invention is believed to lie within the alignment tape 12. Accordingly, and conceivably, the very basic kit according to the present invention may be said to comprise the alignment tape 12 for enabling a user to create a pattern-orienting layout or grid-like layout upon the underlying surface 101 consisting of either parallel rows (or columns) of alignment tape 12, as particularly marked with marks 23 and 24, for enabling the user to particularly and repetitively place or position patterned material upon the underlying surface.

FIG. 17 depicts in particular a series of stickers 70 being positioned and adhesively attached to the underlying surface for forming patterns as at 102. It will be recalled that each alignment tape 12 preferably has a fixed tape width, a select (or variable) tape length, and an especially marked anterior tape surface. The marked anterior tape surface preferably comprises a series of periodic and uniformly spaced width-wise marks as at 23 and a length-wise mark as at 24.

The length-wise mark is preferably centered relative to the fixed tape width. Utilizing the color-coded length segments generally referenced at 38 versus 39, the user may thus utilize a number of sequentially spaced width-wise marks, as summarily spaced, to equal to a select body dimension (e.g. reflective of the width of the patterned body exemplified by a sticker (having a pressure-applicable adhesive backing as at 71)). The select body dimension is thus firstly and successively positionable upon the underlying surface 101 by way of the select number of sequentially spaced width-wise marks for transferring a pattern (e.g. a heart-shaped sticker 70) to the underlying surface 101.

The surface marking kit according to the present invention may thus be said to further and optionally comprise at least one spacer element and at least two alignment tapes. Each one spacer element as at 14, comprising a spacer length 30, is extendable between opposing tape edges as at 33 versus 34 for spacing the at least two alignment tapes 12 relative to one another via the spacer length 30. The length-wise marks 24 of the at least two alignment tapes 12 are thus positionable in parallel relation to one another via the spacer element(s) 14.

The surface marking kit according to the present invention may further be said to preferably and optionally comprise at least one marking material transfer body substantially as earlier described such that each marking material transfer body essentially comprises a fixed body height, a fixed body width, an outer body perimeter, and at least one marking material transfer portion.

The outer body perimeter comprises opposed, parallel mark-alignment edges, and the fixed body height being measurable intermediate the mark-alignment edges. The at least one marking material transfer portion (e.g. a stencil template, a decal body, or a form-based sticker element) is located inwardly of the outer body perimeter. The spacer lengths are in these embodiments equal to the fixed body height less the fixed tape width such that the marking material transfer body overlaps the first and successive alignment tapes at overlap sections adjacent the opposed, parallel mark-alignment edges.

Viewed from a methodological perspective, the surface marking method according to the present invention is believed to enable a user to mark a pattern upon an underlying surface and may be said to essentially and preferably comprise the initial steps of providing a marking material transfer body and a first alignment tape substantially as earlier described. The first alignment tape is removably affixed to a first tape portion of the underlying surface via the adhesively coated posterior tape surface in a first dimension or direction (e.g. horizontal) extending in the direction of the variable or select tape length.

A select template or body dimension of the marking material transfer body is then selected from the group consisting of the fixed body height and the fixed body width. The select body dimension is then positioned at a first select number of sequentially spaced width-wise marks and a first mark alignment edge is positioned in alignment with the first length-wise mark. Marking material may then be directed through the stencil aperture(s) 11 or transferred from the marking material portions 51 for marking a first pattern reflective of the stencil aperture(s) 11 or portions 51 upon the underlying surface.

The surface marking method may comprise the additional steps of re-positioning the select body dimension at a successive select number of sequentially spaced width-wise marks; re-positioning the first mark alignment edge in alignment with the first length-wise mark; and re-directing marking material through the stencil aperture(s) 11 or transferring marking material via the marking material portions 51 for marking a successive pattern reflective of the stencil aperture(s) 11 or portions 51 upon the underlying surface. The first and successive patterns thereby together form a repeat pattern upon the underlying surface.

The surface marking method may be said to further comprise the steps of providing at least one spacer element and at least one successive alignment tape substantially as earlier described. Each successive alignment tape may be aligned in parallel relation to the first alignment tape by way of the spacer element(s) such that successive length-wise mark(s) extend in parallel relation to the first length-wise mark. The step of aligning each successive alignment tape in parallel relation to the first alignment tape by way of the spacer elements may be said to further comprise additional steps.

In this last regard, the additional steps may include the steps of aligning a first length-defining edge of the spacer element(s) at a select first edge of the first alignment tape; extending the spacer element(s) in a second dimension orthogonal to the first dimension; aligning an opposing tape edge of successive alignment tape(s) at a second length-defining edge of the spacer element(s); and aligning the opposed, parallel mark-alignment edges with the first and successive length-wise marks such that the marking material transfer body thereby overlaps the first and successive alignment tapes at overlap sections in adjacency to the opposed, parallel mark-alignment edges.

The step of providing the alignment tapes may be further defined by comprising the step of the color-coding the periodically and uniformly marked anterior tape surface comprises into color-coded length segments or providing a color-coded anterior tape surface. The color-coded length segments may be so color-coded to be equal in length to the select body dimension for enhancing a user's ability to successively position the select body dimension relative to the periodically and uniformly marked anterior tape surface.

Accordingly, although the inventive surface marking system, kit, and method have been described by reference to a number of embodiments and methods, it is not intended that the novel surface marking system, kit, and method heretofore described be limited thereby, but that modifications thereof are intended to be included as falling within the broad scope and spirit of the foregoing disclosure, the following claims, and the appended drawings.

I claim:

1. A surface marking system for enabling a user to mark a repeat pattern upon an underlying surface, the surface marking system comprising, in combination:

a marking material transfer body, the marking material transfer body comprising a fixed body height, a fixed body width, an outer body perimeter, and at least one marking material transfer portion, the outer body perimeter comprising opposed, parallel mark-alignment edges, the fixed body height being measurable intermediate the opposed, parallel mark-alignment edges, the at least one marking material transfer portion being located inwardly of the outer body perimeter;

a first alignment tape and at least one successive alignment tape, the first alignment tape having a fixed tape width, a select tape length, and a periodically and uniformly marked anterior tape surface, the periodically and uniformly marked anterior tape surface comprising a series of periodic and uniformly spaced width-wise marks and a first length-wise mark, the first length-wise mark being centered relative to the fixed tape width for dividing the periodically and uniformly marked anterior tape surface into a first width half and a second width half; and at least one spacer element, the at least one spacer element comprising a spacer length, the spacer length being equal to the fixed body height less the fixed tape width, the at least one successive alignment tape being substantially identical to the first alignment tape, the at least one successive alignment tape comprising a successive length-wise mark for alignment in parallel relation to the first length-wise mark;

a number of sequentially spaced width-wise marks being summarily spaced to equal a select body dimension, the select body dimension being selected from the group consisting of the fixed body height and the fixed body width, the first alignment tape being removably affixable to a first tape portion of the underlying surface in a first direction extending in the direction of the select tape length, the select body dimension being:

(a) firstly positionable at a first select number of sequentially spaced width-wise marks, a first mark-alignment edge being firstly alignable with the first length-wise mark, the at least one marking material transfer portion for transferring a marking material via the marking material transfer body for marking a first pattern reflective of the at least one marking material transfer portion upon the underlying surface, and (b) successively positionable at successive select numbers of sequentially spaced width-wise marks, the first mark-alignment edge being successively alignable with the first length-wise mark, the at least one marking material transfer portion for transferring the marking material via the marking material transfer body for marking a successive pattern upon the underlying surface, the first and successive patterns together forming a repeat pattern reflective of the at least one marking material transfer portion.

2. The surface marking system of claim 1 wherein a first length-defining edge of the at least one spacer element is alignable at a select tape edge of the first alignment tape and extendable in a second direction orthogonal to the first direction, an opposing tape edge of the at least one successive alignment tape being alignable at a second length-defining edge of the at least one spacer element, the at least one successive alignment tape being thus being alignable in parallel relation relative to the first alignment tape such that the opposed, parallel mark-alignment edges are alignable with the first and successive length-wise marks, the marking material transfer body thus overlapping the first and successive alignment tapes at overlap sections adjacent the opposed, parallel mark-alignment edges.

3. The surface marking system of claim 2 wherein the at least one spacer element comprises a spacer width, the spacer width at the first and second length-defining edges for enhancing the user's ability to space the first and at least one successive alignment tapes in parallel relation to one another.

4. The surface marking system of claim 1 comprising at least two spacer elements, the at least two spacer elements being alignable in parallel relation to one another for enhancing the user's ability to space the first and successive alignment tapes in parallel relation to one another.

5. The surface marking system of claim 1 wherein the periodically and uniformly marked anterior tape surface comprises color coded length segments, the color-coded length segments being equal in length to the select body dimension for enhancing the user's ability to successively position the select body dimension relative to the periodically and uniformly marked anterior tape surface.

6. A surface marking kit for enabling a user to mark a pattern upon an underlying surface, the surface marking kit comprising:

at least one marking material transfer body, the at least one marking material transfer body comprising a fixed body height, a fixed body width, an outer body perimeter, and at least one marking material transfer portion, the outer body perimeter comprising opposed, parallel mark-alignment edges, the fixed body height being measurable intermediate the mark-alignment edges, the at least one marking material transfer portion being located inwardly of the outer body perimeter;

at least two alignment tapes, the at least two alignment tapes each having a fixed tape width, a select tape length, and a marked anterior tape surface, the marked anterior tape surfaces of the at least two alignment tapes each comprising a series of periodic and uniformly spaced width-wise marks and a length-wise mark, the length-wise marks of the at least two alignment tapes each being centered relative to the fixed tape widths of the at least two alignment tapes; and at least one spacer element, the at least one spacer element comprising a spacer length, the spacer length being equal to the fixed body height less the fixed tape width, the length-wise marks of the at least two alignment tapes being positionable in parallel relation to one another via the at least one spacer element;

a number of sequentially spaced width-wise marks being summarily spaced to equal to a select body dimension, the select body dimension being selected from the group consisting of the fixed body height and the fixed body width, the at least two alignment tapes each being removably affixable to a tape portion of the underlying surface, the select body dimension being:

firstly and successively positionable at a select number of sequentially spaced width-wise marks and a first mark-alignment edge being firstly and successively alignable with a first length-wise mark, the at least one marking material transfer portion for transferring a marking material via at least one marking material transfer body for marking a pattern upon the underlying surface.

7. The surface marking kit of claim 6 wherein a first length-defining edge of the at least one spacer element is alignable at a select edge of a first alignment tape, an opposing tape edge of a second alignment tape being alignable at a second length-defining edge of the at least one spacer element, the second alignment tape being alignable in parallel relation relative to the first alignment tape via the at least one spacer element such that the opposed, parallel mark-alignment edges are alignable with the length-wise marks of the first and second alignment tapes, the at least one marking material transfer body thus overlapping the first and second alignment tapes at overlap sections adjacent the opposed, parallel mark-alignment edges.

8. The surface marking kit of claim 7 comprising at least two spacer elements, the at least two spacer elements being alignable in parallel relation to one another for enhancing the user's ability to space the first and second alignment tapes in parallel relation to one another.

9. The surface marking kit of claim 7 wherein the at least one spacer element comprises a spacer width, the spacer width at the first and second length-defining edges for enhancing the user's ability to space the first and second alignment tapes in parallel relation to one another.

10. The surface marking kit of claim 6 wherein the marked anterior tape surface comprises color-coded length segments, the color-coded length segments being equal in length to the select body dimension for enhancing the user's ability to successively position the select body dimension relative to the marked anterior tape surface.

11. A surface marking kit for enabling a user to create a pattern-orienting layout upon an underlying surface, the surface marking kit comprising:

at least two alignment tapes, the at least two alignment tapes each having a fixed tape width, a select tape length, and a marked anterior tape surface, the marked anterior tape surfaces of the at least two alignment tapes each comprising a series of periodic and uniformly spaced width-wise marks and a length-wise mark, the length-wise marks of the at least two alignment tapes each being centered relative to the fixed tape widths of the at least two alignment tapes; and at least one spacer element, the at least one spacer element comprising a spacer length, the spacer length being extendable between opposing tape edges for spacing the at least two alignment tapes relative to one another, the length-wise marks of the at least two alignment tapes thus being positionable in parallel relation to one another via the at least one spacer element;

a number of sequentially spaced width-wise marks being summarily spaced to equal to a select body dimension, the select body dimension being firstly and successively positionable upon the underlying surface by way of the select number of sequentially spaced width-wise marks for transferring a pattern to the underlying surface.

12. The surface marking kit of claim 11 comprising at least one marking material transfer body, the at least one marking material transfer body comprising a fixed body height, a fixed body width, an outer body perimeter, and at least one marking material transfer portion, the outer body perimeter comprising opposed, parallel mark-alignment edges, the fixed body height being measurable intermediate the mark-alignment edges, the at least one marking material transfer portion being located inwardly of the outer body perimeter, the spacer length being equal to the fixed body height less the fixed tape width, the marking material transfer body thus overlapping the first and successive alignment tapes at overlap sections adjacent the opposed, parallel mark-alignment edges.

* * * * *